US005826432A

United States Patent [19]

Ledbetter

[11] Patent Number: 5,826,432

[45] Date of Patent: Oct. 27, 1998

[54] BLAST CHILLER

[75] Inventor: Baldwin G. Ledbetter, Anaheim, Calif.

[73] Assignee: El Cold, Inc., Commerce, Calif.

[21] Appl. No.: 516,536

[22] Filed: Aug. 18, 1995

[51] Int. Cl.[6] ..... F25B 25/00

[52] U.S. Cl. ..... 62/62; 62/237; 62/265; 62/228.1; 62/440; 236/78 B

[58] Field of Search ..... 62/237, 265, 440, 62/228.1, 62; 236/78 B

[56] References Cited

U.S. PATENT DOCUMENTS

| | | | |
|---|---|---|---|
| 2,506,448 | 5/1950 | Gregor | 62/237 |
| 3,392,543 | 7/1968 | Miller | 62/237 |
| 3,690,118 | 9/1972 | Rainwater | 62/237 |
| 4,262,737 | 4/1981 | Faillace | 236/78 B |
| 4,760,708 | 8/1988 | Karashima | 62/256 |

OTHER PUBLICATIONS

Jerry D. Maahs, "Cook/Chill from Preparation Through Service" (undated), pp. 16–18.

Southern California Edison brochure entitled "Cook–Chill Made Easy at CTAC," *Culinary Connections* (Jul. 1993), pp. 4, 6.

Master–Bilt sales brochure, "Master–Chill Single and Dual Cart Quick–Chill" (Sep. 1993).

Bally Engineered Structures, Inc. sales brochure, "Northwind Blast Chillers" (catalog No. 93–131) 1993.

Bally Engineered Structures, Inc. sales brochure, "Northwind (1000)" (catalog No. 90–296) 1991.

Bally Engineered Structures, Inc. sales brochure, "Northwind 500 UR Blast Chiller" (undated).

USECO sales brochure, "Rota–Chill Blast Chiller (Model 34–101, 34–101PT, 34–102, 34–102PT)"(undated).

Vulcan–Hart Corporation sales brochure, "VBC 45 Blast Chiller; VBC 45 Blast Freezer" (RIN–15) (Mar. 1987).

Vulcan–Hart Corporation sales brochure, "Blast Chiller Model: VBC–130" (RIN–26) (Mar. 1987).

Vulcan–Hart Corporation sales brochure, "Blast Chiller Model: VBC–180" (RIN–27) (Mar. 1987).

Control Products sales brochure, "Temperature Timer Controller TTC–110HC, TTC–111HC" (Oct. 1994).

*Primary Examiner*—Ronald C. Capossela
*Attorney, Agent, or Firm*—Lyon & Lyon LLP

[57] ABSTRACT

A chiller having a forced air means and a pressure plenum so as to provide a suitably concentrated and even air flow and distribution through spatial gaps between trays on one or more insertable food racks. The plenum has a high pressure cavity at one end and a low pressure cavity at the opposite end. A motorized fan mounted above the plenum and separated therefrom by a ceiling plate draws chilled air from the low pressure chamber and forces it into the high pressure chamber in front of the plenum. A turning vane directs the air into high pressure chamber and reduces potential turbulence. The walls leading from the high pressure cavity to the plenum are preferably tapered at least in part so as to force air into the plenum in a funnel-like manner, and uniformly through spatial gaps between the trays on the rack or racks. A multi-function controller controls the chilling operation by allowing selection of either a chill time or a target product temperature. An internal probe measures the product temperature and provides sensory information to the multi-function controller.

32 Claims, 25 Drawing Sheets

OUTSIDE CONTROL PANEL DESCRIPTION

AIR PLENUM PANELS

AIR PLENUM PANELS

DRAIN PAN COVER

DRAIN PAN

BLAST CHILLER

BACKGROUND OF THE INVENTION

1) Field of the Invention

The field of the present invention relates to the rapid chilling of food or other products and, more particularly, to an apparatus and method for blast chilling used, for example, in cook-chill operations.

2) Description of the Related Art

Foods both prepared and unprepared often need to be stored for later use or transportation. A particular need has arisen for the capability to rapidly cool prepared foods for storage by large-scale food service operations. Such operations include, for example, commissaries, hospitals, schools, prisons and correctional institutions, airport in-flight kitchens, convention centers, hotel banquets, cruise ships, and business cafeterias, to name a few. The term "cook-chill" is often used to describe a process of cooking or preparing food (usually in large volume) and then chilling it for refrigerated storage, to be reheated and served at a later time, typically within a few days.

Efficient and rapid cooling of food generally prolongs storage life and therefore minimizes cooking and food preparation activities. This enables food preparation to be performed with a smaller staff and at convenient times, rather than requiring lengthy preparation before every mealtime. By employing a cook-chill process, large volumes of food can be prepared by skilled chefs and kitchen staff working ordinary day shifts, and the food can be readily available for night shift or weekend meals by simple reheating.

Rapid chilling is needed to prevent irreversible deterioration of prepared foods. When left at the warm "danger zone" (temperatures usually in the range of 45° to 140°), cooked food deteriorates quickly due to the action of organisms and enzymic and chemical reactions. A reduction in the storage temperature slows the exponential multiplication of bacteria and other microorganisms and also slows the chemical and enzymic reactions. At normal refrigeration temperatures reactions and bacteria growth still take place, but at a much slower rate.

Rapid chilling of cooked food maximizes shelf life without sacrificing its quality and physical appearance. Existing food safety guidelines require that certain hot food products be chilled from cooking temperatures to 140° F. and then to 40° F. in a specific period of time, typically about 90 minutes. A standard refrigerated room or storage refrigerator/freezer is designed for storage of food products, and is incapable of lowering the food product's initial temperature with sufficient rapidity to ensure against bacterial growth and chemical reactions. This is because standard refrigeration units are designed to work according to principles of natural convection whereby warm ambient air adjacent to the hot food products rises due to its lower density to be replaced by cooler air through the force of gravity. The rate of heat transfer from a heated object placed in a standard refrigeration unit is limited because the gravity induced air flow is incapable of cooling at a rapid enough rate. Additionally, a thin insulating layer of condensation may form around the food product or its container, further slowing the rate of heat transfer and prolonging cooling time.

A blast chiller is generally premised on the principles of forced convection whereby chilled air is forced through and over the food product trays at a high velocity induced by a high powered fan. A conventional blast chiller typically consists of an insulated refrigerated chamber which is equipped with access means to receive trays of hot food product as well as with an internal fan so as to circulate the chilled air over the food product. Conventional blast chillers employ a variety of techniques for moving the air over the food trays: directly blasting the air over the trays; pulling the air over the trays; and rotating the trays relative to the chamber's chilled air so as to create a relative velocity therebetween.

These approaches, however, are rife with problems such as uneven air flow (and as a result, uneven temperature distribution within the food product), reduced fan efficiency, and unduly long cooling times. Moreover, blast chillers having rotating trays have a greater potential for mechanical breakdown due to the increased number of moving parts. Uneven cooling is a particular problem because it provides ideal conditions for localized growth of microorganisms, and may go undetected by a sensor or set of sensors which cannot physically monitor every food location simultaneously. It is therefore insufficient merely to increase air flow over food products to be cooled in order to reduce cooling time; evenness of air flow is also required.

Directly blasting air across trays may cause undue turbulence, which adversely affects heat transfer from products placed on the food trays. In addition, the force of air from the fans may blow food or other matter off of the trays.

FIG. 1 depicts one type of conventional blast chiller, in which fans 50 pull air out of the open slots of the food rack 51. While avoiding some of the problems inherent in having the fans blow directly across the product, the sharp corners 52 of the interior chamber 53 of the FIG. 1 blast chiller cause turbulence and inefficiencies of air flow. This affects both the rate and evenness of the air flow across the product on the rack 51.

FIG. 2 is a diagram of another similar conventional blast chiller. In the FIG. 2 blast chiller, the fans 60 are also configured to pull air through slots 62 of the food rack 61. As can be easily observed, the air flow path is lengthy and has at least four right-angle direction changes, resulting in significant nonuniformities in the air flow distribution and noticeable pressure drops due to the direct impact of forced air against the wall opposite the motorized fans. The unevenness of the air flow and the loss of pressure not only requires use of a higher power fan than otherwise would be required, but also may lead to localized hot spots in the food trays.

Another type of conventional blast chiller utilizes a food rack coupled with a rotating carousel. While this design may to some degree alleviate warm air pockets, it is prone to frequent breakdown because of the inevitable failure of moving parts. Further, this blast chiller design does not assure uniform and even air flow through the slots between the food trays and has associated with it a significant pressure drop resulting in reduced air flow rate and cooling rate.

It would accordingly be advantageous to provide a means for rapidly chilling food products to prolong shelf life and minimize harmful bacterial growth and enzymatic or chemical reactions. It would further be advantageous to provide an improved blast chiller having increased efficiency and uniformity of air flow. It would further be advantageous to provide such a blast chiller capable of generating increased, concentrated and even air flow across food and non-food items placed on trays.

Another problem in conventional blast chillers is the relatively limited control capability with respect to chilling operations. Typically, a timer is set which controls the length of the chilling period. However, the length of time a product takes to cool may be uncertain. If the food is not chilled to the proper temperature when the timer has run out, then the operator needs to reset the timer and wait for the product to cool down to the desired temperature. If the operator sets the timer too long, then the food can be chilled below the optimum temperature, causing partial dehydration or "freezer burn". Monitoring the blast chiller to prevent overchilling may be inconvenient and distract kitchen personnel from other tasks.

Accordingly, it would be advantageous to provide a blast chiller having a more flexible means of control and requiring less operator supervision, without having the risk of underchilling or overchilling the product to be cooled. It would further be advantageous to provide such a blast chiller having improved air flow efficiency and uniformity.

SUMMARY OF THE INVENTION

The present invention in one aspect relates to a chiller with a forced air means and a uniquely designed pressure plenum or chamber so as to provide a suitably concentrated and even air flow and distribution through spatial gaps between trays of an insertable food rack. By the use of the enclosed plenum, a pressure chamber is created with high positive air pressure within and in front of the plenum. A single or double cart of hot food is placed within the plenum area, and a stream of uniform cold air is drawn across each tray area at relatively high velocity. When exiting the plenum, the cold air is pulled through an evaporator toward the negative pressure side of the fan, and is thereafter recirculated in a similar pattern.

In one embodiment, the blast chiller comprises an insulated housing which is equipped with an open chamber (i.e., a plenum) which is adapted to receive a cart or rack having trays holding, e.g., hot food products. The plenum is covered with a ceiling plate, and an internal motorized fan is positioned above the ceiling plate to provide circulation of chilled air across the top of the ceiling plate, into a high pressure cavity, and then over trays containing the food products. The walls leading from the high pressure cavity to the plenum are preferably tapered or partially tapered so as to force air into the plenum in a targeted manner, and uniformly through spatial gaps between the trays on the rack. A low pressure cavity is located behind the plenum and at the opposite end of the inserted cart or rack. The fan pulls air out of the low pressure cavity, the suction resulting in low pressure. The pressure difference between the low pressure cavity and high pressure cavity assists in the circulation and evenness of air flow across the food trays. A standard radiator (e.g., a DX coil or finned surface coil) provides chilling of the air, while the motorized fan provides forced air pressure.

In another embodiment, turning vanes are added at the top of the high pressure cavity, to direct the air flow into the high pressure cavity and, from there, across the food trays. The turning vanes reduce turbulence associated with forcing air through sharp, right-angle turns.

Another embodiment comprises a blast chiller including a multi-function controller, whereby a chilling operation may be controlled either by a selected time or a selected target product temperature. An internal probe or similar sensing means is used to monitor the product temperature. If time control alone is used, then the chilling cycle is suspended when the chill control timer times out. If product temperature control is also used, then the controller suspends the chilling cycle when the target product temperature is reached. In a particular embodiment, chilling will continue until the target product temperature is reached regardless of when the chill timer times out.

Preferred embodiments of the invention may comprise a single cart or a multi-cart design. Other embodiments are disclosed in which the fan position is altered, or the shape or characteristics of the plenum modified. Other variations and embodiments are further discussed herein.

BRIEF DESCRIPTION OF THE DRAWINGS

The various objects, features and advantages of the present invention may be better understood by examining the Detailed Description of the Preferred Embodiments found below, together with the appended figures, wherein.

DETAILED DESCRIPTION OF THE PREFERRED EMBODIMENTS

Figure 1:
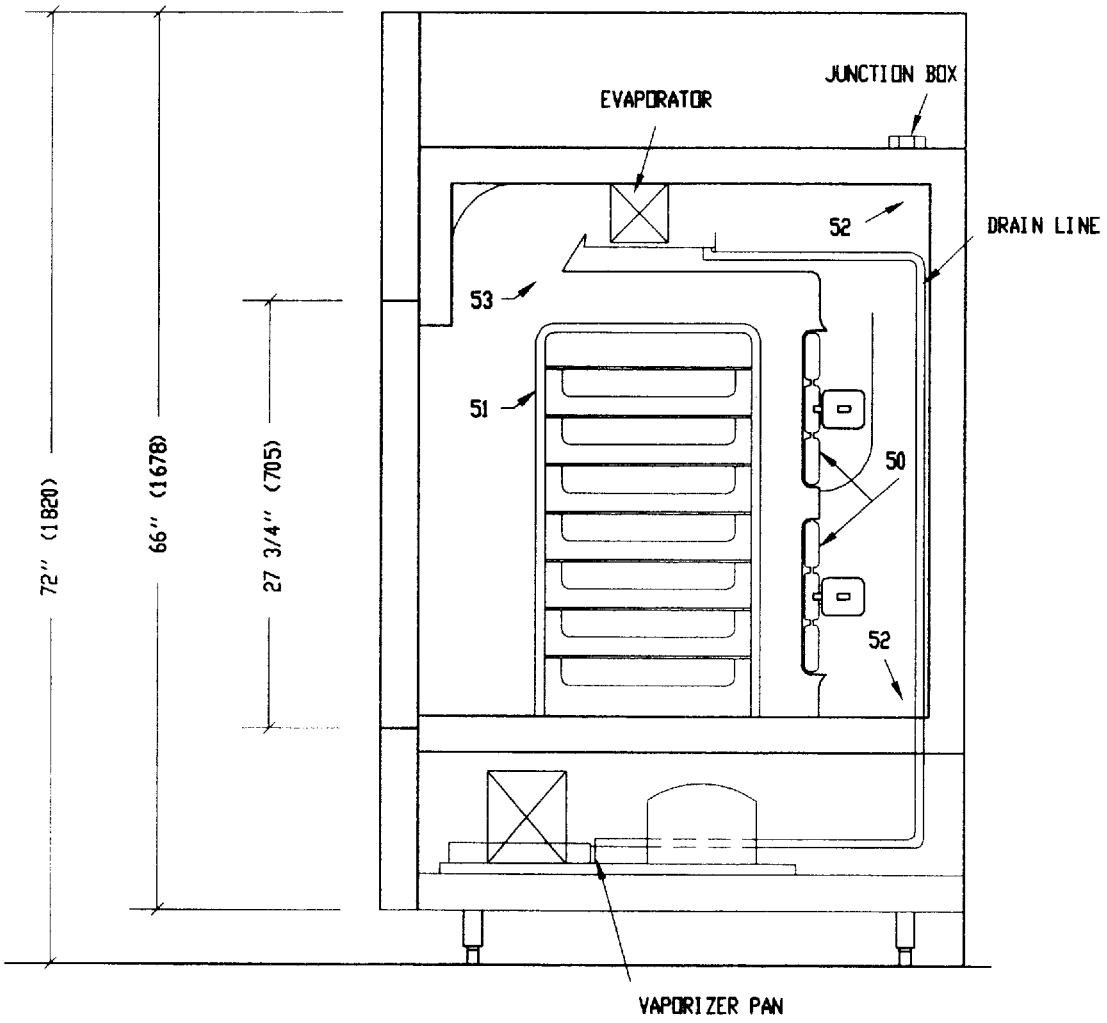
FIGURE 1 (PRIOR ART)
FIG. 1 is a diagram of one type of conventional blast chiller.
Figure 2:
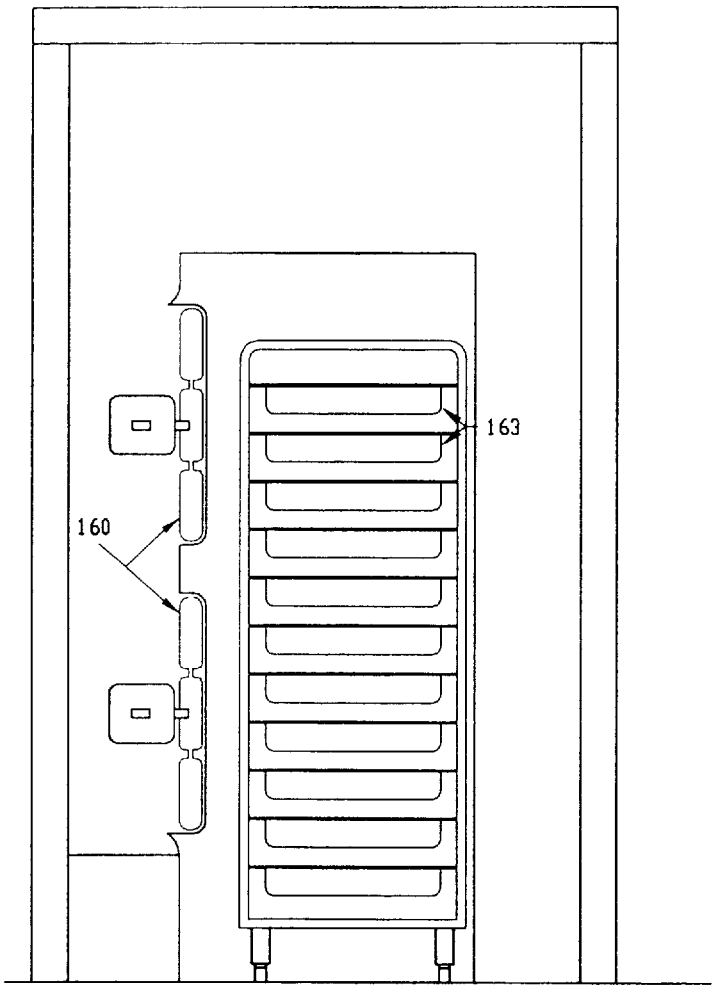
FIGURE 2 (PRIOR ART)
FIG. 2 is a diagram of another type of conventional blast chiller.
Figure 3:
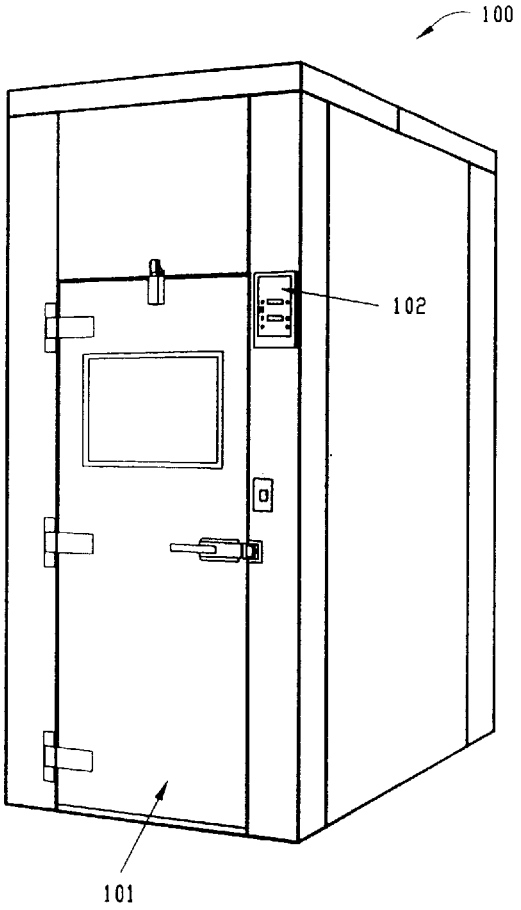
FIG. 3 is an isometric view of a housing of a single cart blast chiller in accordance with one embodiment of the present invention.
Figure 4:
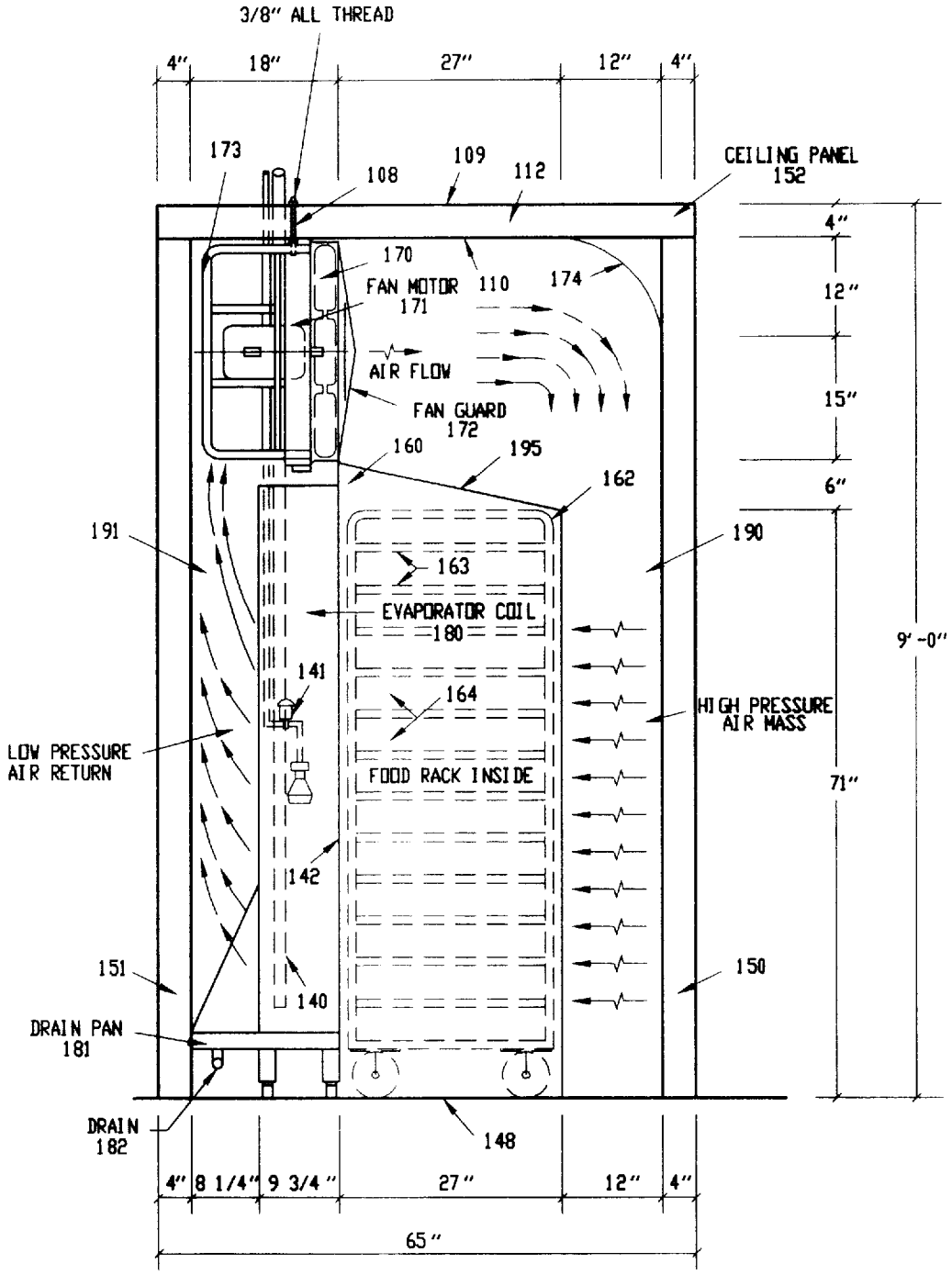
FIG. 4 is a sectional view of the single cart blast chiller of FIG. 3.

FIG. 3 is a diagram showing an isometric view of a housing 100 of a single-cart blast chiller in accordance with one embodiment of the present invention. As shown in FIG. 4, housing 100 is preferably constructed of a durable and sturdy material with insulating qualities, such as 20-gauge type 304 stainless steel interior panels 110 and exterior panels 109 having a layer of insulating material 112 therebetween. The interior of the housing 100 is generally referred to herein as the blast chiller chamber. In a preferred embodiment, the insulating material 112 comprises approximately four inches of class 1 urethane foam having a nominal density of 2.2 pounds per cubic foot. Panel joints of the interior stainless steel panels 110 and exterior stainless steel panels 109 are sealed with PVC gaskets, and are rigidly coupled by cam action locks set into the insulating material 112 no more than four feet apart.

The housing 100 has a door 101 which is also preferably constructed of stainless steel plates having several inches (e.g., three inches) of class 1 urethane foam therebetween. The door 101 allows insertion in or removal from a blast chiller chamber of carts or racks bearing products to be chilled. A control panel 102 is attached to the outside of the housing 100 to allow operator control and varying of the chilling temperature and time. The control panel 102 and corresponding command operations are explained in more detail herein with respect to FIGS. 11A through 11C.

Figure 5:
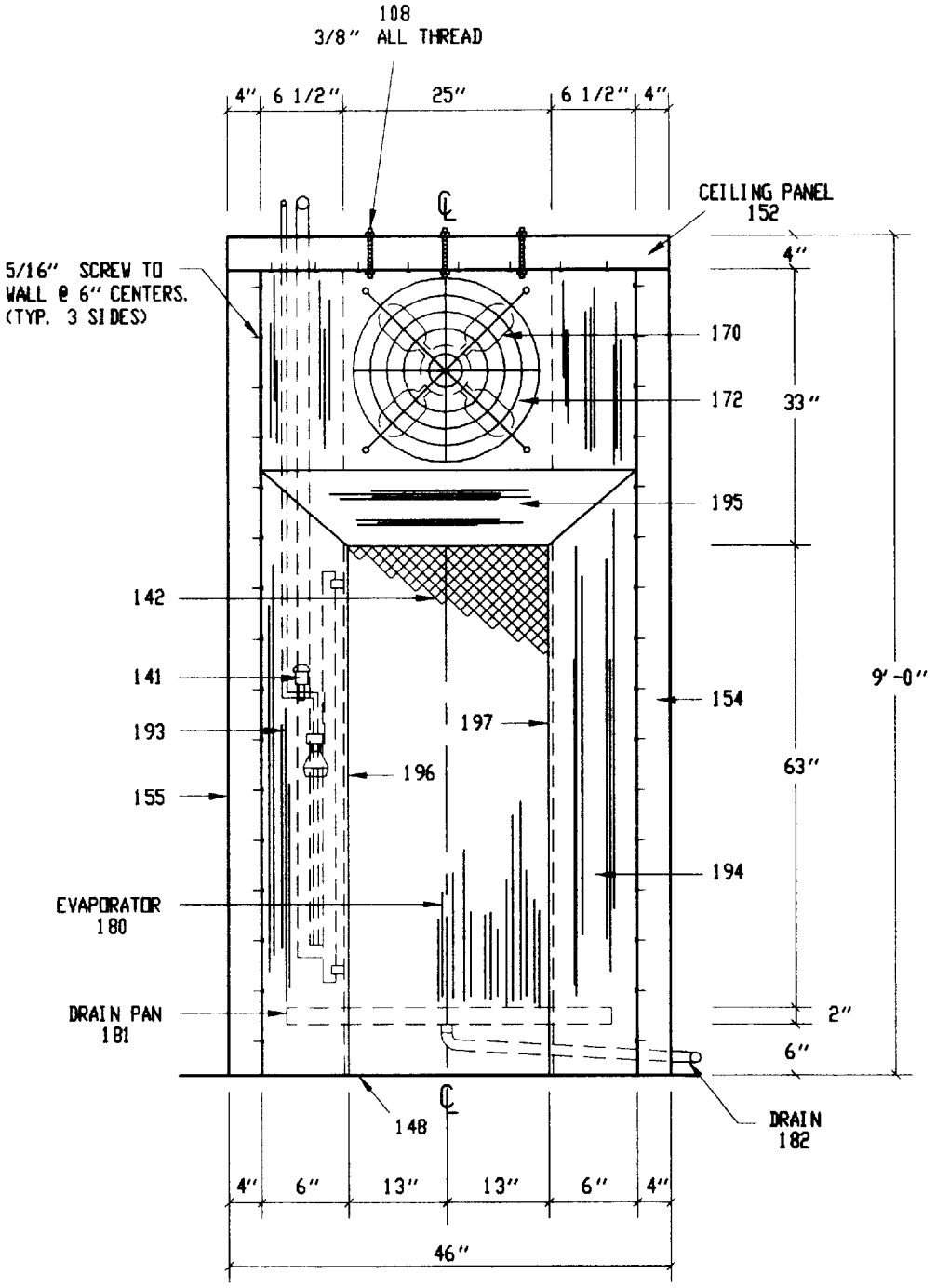
FIG. 5 is a front sectional view of the single cart blast chiller of FIG. 3.
Figure 6:
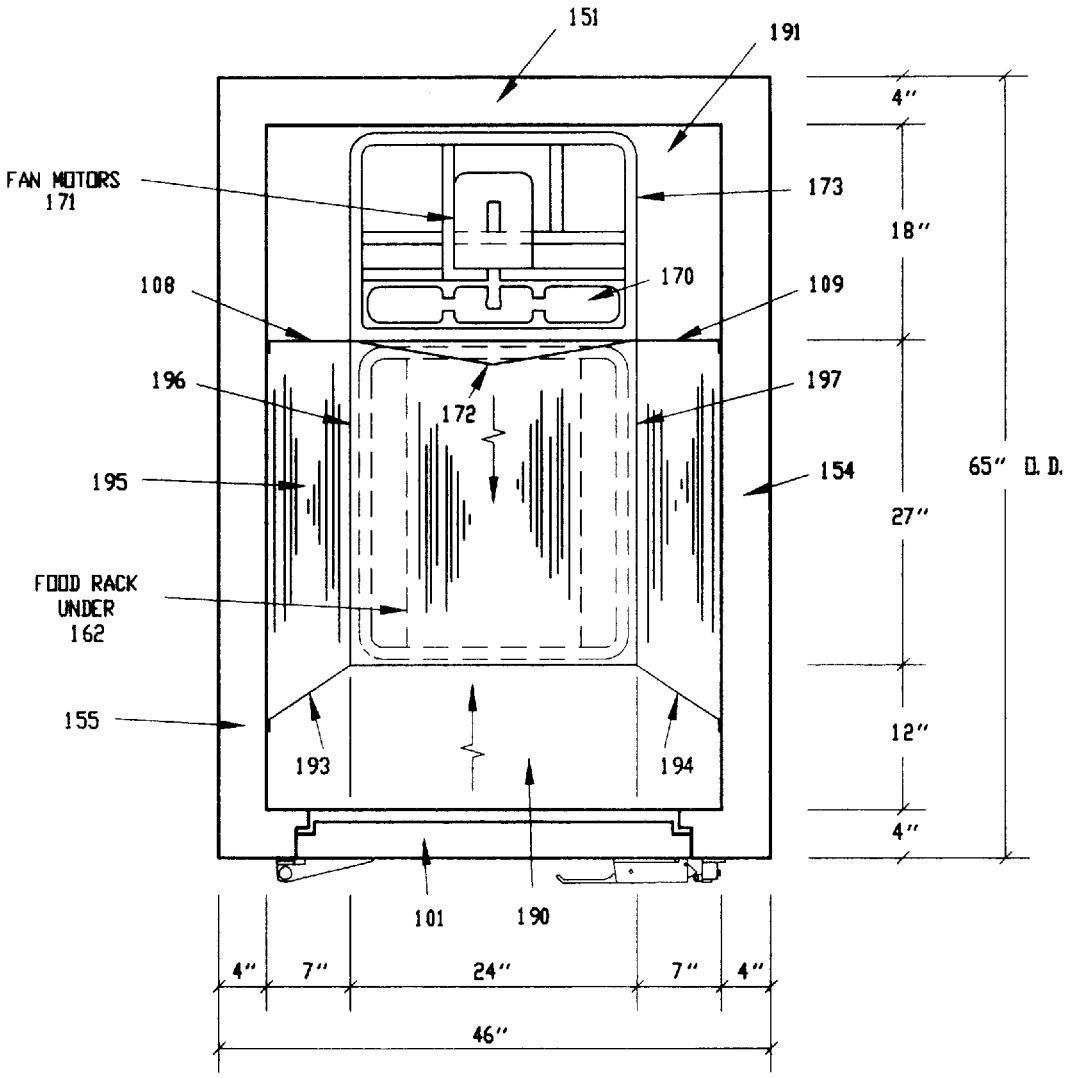
FIG. 6 is a plan view (with open ceiling) of the blast chiller of FIG. 3.

FIGS. 4, 5 and 6 are diagrams showing different views of the internal characteristics of the FIG. 3 blast chiller, along with preferred dimensions. FIG. 4 is a sectional view; FIG. 5 is a front sectional view; and FIG. 6 is a plan view (with open ceiling). As shown in FIG. 4, the blast chiller in this embodiment comprises a front housing wall 150, a rear housing wall 151, and a housing ceiling panel 152. FIGS. 5 and 6 further show side housing walls 154 and 155. The front housing wall 150, rear housing wall 151, housing ceiling panel 152, and side housing walls 154 and 155 are all part of the housing 100 shown in FIG. 3.

The interior of the blast chiller of the embodiment shown in FIGS. 4–6 comprises a pressure plenum 160 adapted to receive a cart or rack 162 having a number of shelves or trays 163. The plenum 160 is generally a chamber which conforms closely to the width dimensions of the cart 162 bearing food products. The plenum 160 is open at front and back ends, and is defined by a floor 198, a pair of plenum side panels 196 and 197, and a plenum ceiling plate 195. The plenum ceiling plate 195 is positioned so that the cart 162 fits underneath it without too much excess room (e.g., about 2 inches) above the top of the cart 162. Likewise, the plenum side panels 196, 197 are constructed so as to conform closely to the width of the cart 162 without too much excess airspace (preferably less than, e.g., 1 inch) between each side of the cart 162 and the respective plenum side panel 196, 197.

The plenum side panels 196, 197 and plenum ceiling plate 195 are preferably constructed of rigid, durable material such as 16-gauge type 304 stainless steel plating.

Above the plenum 160 is positioned a fan 170, which may be constructed of cast aluminum. The fan 170 is powered by a fan motor 171 which may be, e.g., a 2-horsepower electric motor. The fan motor 171 is connected to a frame 173 which is mounted to the ceiling housing panel 152 by suitable fastening means such as ⅜" nylon all-thread rods 108. The fan 170 has a fan guard 172 located in front of it, and may be aligned so as to be roughly even with the back edge of an inserted cart 162. The fan 170 is generally positioned so as to blow air across the top of the plenum ceiling plate 195 and towards the front housing panel 150.

In front of the plenum 160 is a high pressure cavity or chamber 190 generally defined by the front housing wall 150 (including the door 101), the front of the plenum 160, and the two side housing walls 154, 155. Air is directed from the high pressure cavity 190 in a funnel-like manner into the plenum 160 by the plenum air walls 193 and 194, which taper from the side housing walls 154, 155 to the plenum side panels 196, 197. The effect of the tapered plenum air walls 193, 194 is explained in more detail hereinafter.

Behind the plenum 160 is a low pressure cavity or chamber 191 generally defined by the rear housing wall 151, the rear of the plenum 160 (including plenum back air walls 108 and 109), and the two side housing walls 154, 155 (or, alternatively, extensions of the plenum side panels 196, 197 instead of the two side housing walls 154, 155). Low pressure is maintained in the low pressure cavity 191 by the suction action of the fan 170. The expansion of air from the plenum 160 (whose width is defined by the position of the plenum side panels 196, 197) to the low pressure cavity 191 (whose width is defined by the position of the side housing walls 154, 155) further assists in the creation of low pressure in the low pressure cavity 191.

Cooling of the air inside the blast chiller is provided by a well-known assembly of an evaporator 180 and an air cooled or water cooled condensing unit (not shown) situated outside the blast chiller chamber, together with operation of the fan 170 for circulating the air. With or without the action of the fan 170, product (e.g., hot food) placed on the rack 160 inside the plenum 160 would gradually lose its thermal energy to the colder air inside the chamber. The heated air in turn would transfer its thermal energy to the evaporator 180. The evaporator 180 may circulate any suitable coolant such as, e.g., chlorofluorocarbon freon (also known as R-22). Circulating coolant evaporates due to transfer of thermal energy from air heated by the hot product on the rack 162 to the evaporator 180. The evaporated coolant circulates through the external condensing unit, wherein it condenses and transfers its thermal energy to the medium outside the blast chilling chamber.

The coils of the evaporator 180 are connected to a suction header 140, which is connected to the external condensing unit. The condensing unit may comprise, for example, a Copland semi-hermetic Discus compressor. The condensing unit connects to an expansion valve 141, which connects to a distributor (not shown). The distributor provides refrigerant to the coils of the evaporator 180. A pressure switch may be located on the condensing unit, and may be set to a selected pressure amount. The lower the pressure setting, the lower the temperature of the refrigerant. The pressure switch for cook-chill operations may be set at a pressure corresponding approximately to a temperature in the range of, for example, 20 degrees Fahrenheit. When the selected pressure is reached, the expansion valve 141 closes, temporarily shutting off, in whole or in part, the supply of coolant until the temperature rises to a sufficient degree. The amount of temperature rise necessary to restore the level of coolant may be determined by a level of hysterisis. The use of a pressure switch to control refrigeration temperature is well known in the art.

The temperature of the evaporator 180 is selected so as to maintain suitable humidity in the blast chiller chamber (preferably in the 90% to 95% range) and therefore minimize dehydration of food products placed on the trays 163 in the rack 162. To achieve this humidity level, the temperature of the evaporator fluid is regulated (e.g., by changing the pressure of the condenser) so as to maintain an approximate temperature differential between the evaporator temperature and the chamber temperature. Preferably, about a seven to ten degree temperature differential between the two temperatures is maintained, which corresponds to about a 90% to 95% humidity level. Less humidity may be suitable for some operations. For example, a twelve to fifteen degree temperature differential generally results in about an 85% humidity level, and a sixteen to twenty degree temperature differential generally results in about a 75% humidity level.

Hot air coming off the rack 162 may release condensation on the cold outer coils of the evaporator 180. Condensation dripping from the evaporator 180 is collected in a drain pan 181, and thereafter is released out of a drain 182. Alternatively, a vaporizer pan may be utilized, which collects the condensation internally and heats it to return it to the air in the form of evaporation. While a vaporizer pan may make the blast chiller more self contained, it adds parts subject to potential electrical or mechanical failure, and is vulnerable to corrosion. Therefore, the drain pan 181 and drain 182 configuration is preferred.

A metal grill 142 is positioned at the back edge of the plenum 160, between an inserted rack 162 and the evaporator 180. The metal grill 142 may be comprised of stainless steel and have approximately ½-inch diamond-shaped holes. The metal grill 142 serves as a barrier between the evaporator 180 and the rack 162, and prevents damage to the rack 162 or injury to persons from sharp edges of the evaporator coils, and also prevents most items which could be blown off the trays 163 from leaving the plenum 160.

To enhance the rate of cooling of the product placed on the rack 162, the refrigerated air inside the blast chiller chamber is circulated at a relatively high velocity by means of the fan 170 (or fans). The design of the plenum 160 and associated interior chamber structure is intended to enhance air velocity across the trays 163 of the food rack 162 and maintain evenness of air flow. The fan 170 is situated such that it does not blow directly into the spaces 164 between the trays 163. Rather, by being placed above the rack 162, and disposed to one side of the chamber, the air out of the fan is allowed sufficient space to develop and close out its initial vorticity. A turning vane 174 helps to direct the air flow downward into the high pressure chamber 190 without causing the turbulence associated with sharp, 90-degree corners.

The fan configuration also creates a pressure differential across the food rack 162 in the direction of the air flow. This pressure differential helps pull the air out of the spaces 164 between the trays 163 and provides uniformity of air flow across the trays 163. The plenum 160 serves to guide and channel the air blown by the fan 170 into the spaces 164. In particular, the tapered plenum air walls 193, 194 compress the air flow and target the air in a funnel-like manner into the plenum 160, and consequently into the spaces 164 separating the trays 163. Without the plenum 160, the cold air pushed by the fan 170 into the high pressure cavity 190 may be partially diverted into the space between the housing side walls 154, 155 and the rack 162. The absence of the plenum 160 would therefore result in a reduced air flow through the spaces 164 between the trays 163, reduced heat transfer, and longer cooling time of the product. The plenum 160 also minimizes turbulence and separation of flow as the air enters the spaces 164 between the trays 163, which results in further improved heat transfer from the product.

Figure 12A:
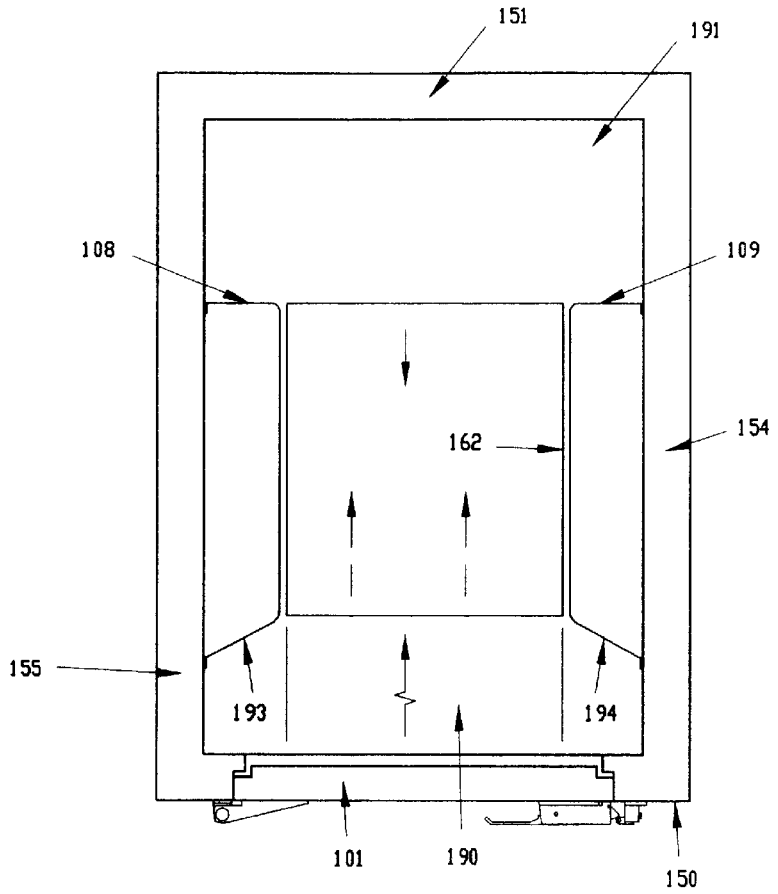
FIGS. 12A and 12B are diagrams of a top view and a side view, respectively, generally illustrating flow of air inside the blast chiller chamber.
Figure 12B:
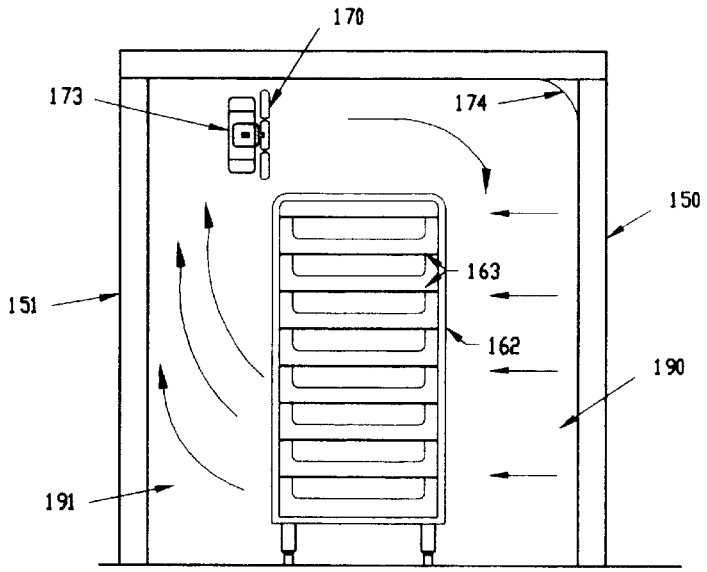

FIGS. 12A and 12B generally diagram the air flow inside the blast chiller chamber, and are idealized somewhat by the absence of certain elements depicted in FIGS. 4–6. In FIGS. 12A and 12B, the large arrows generally illustrate the flow of air. FIG. 12A is a top view of the blast chiller, and FIG. 12B is a side view. As illustrated in FIGS. 12A and 12B, air is forced by the fan 170 into the high pressure cavity 190, being directed therein by the turning vane 174. Simultaneously, air is pulled up to the fan 170 from the low pressure cavity 191, due to the suction action of the fan 170. A rack or cart 162 is placed between the high pressure cavity 190 and the low pressure cavity 191, and the pressure differential between the two cavities causes the high pressure air to move forcefully across the trays 163 of the rack 162. Further, the tapered plenum air walls 193, 194 compress the air flow across the rack 162, assisting in the creation of an even yet strong flow of cool air across the hot products placed on the shelves or trays 163 of the rack 162.

Figure 14A:
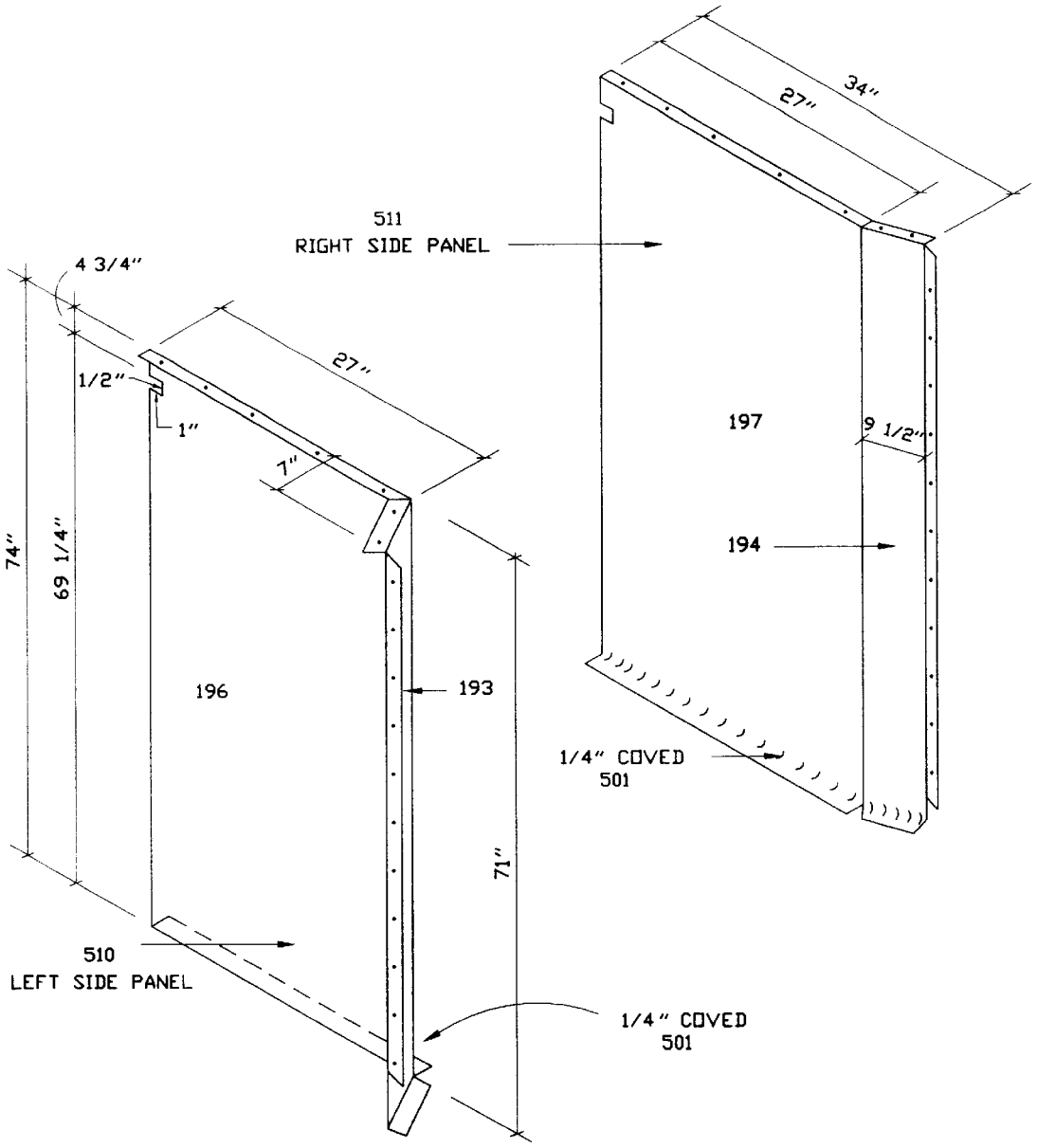
FIGS. 14A and 14B are diagrams of components used to form the plenum area shown in the FIG. 3 embodiment.
Figure 14B:
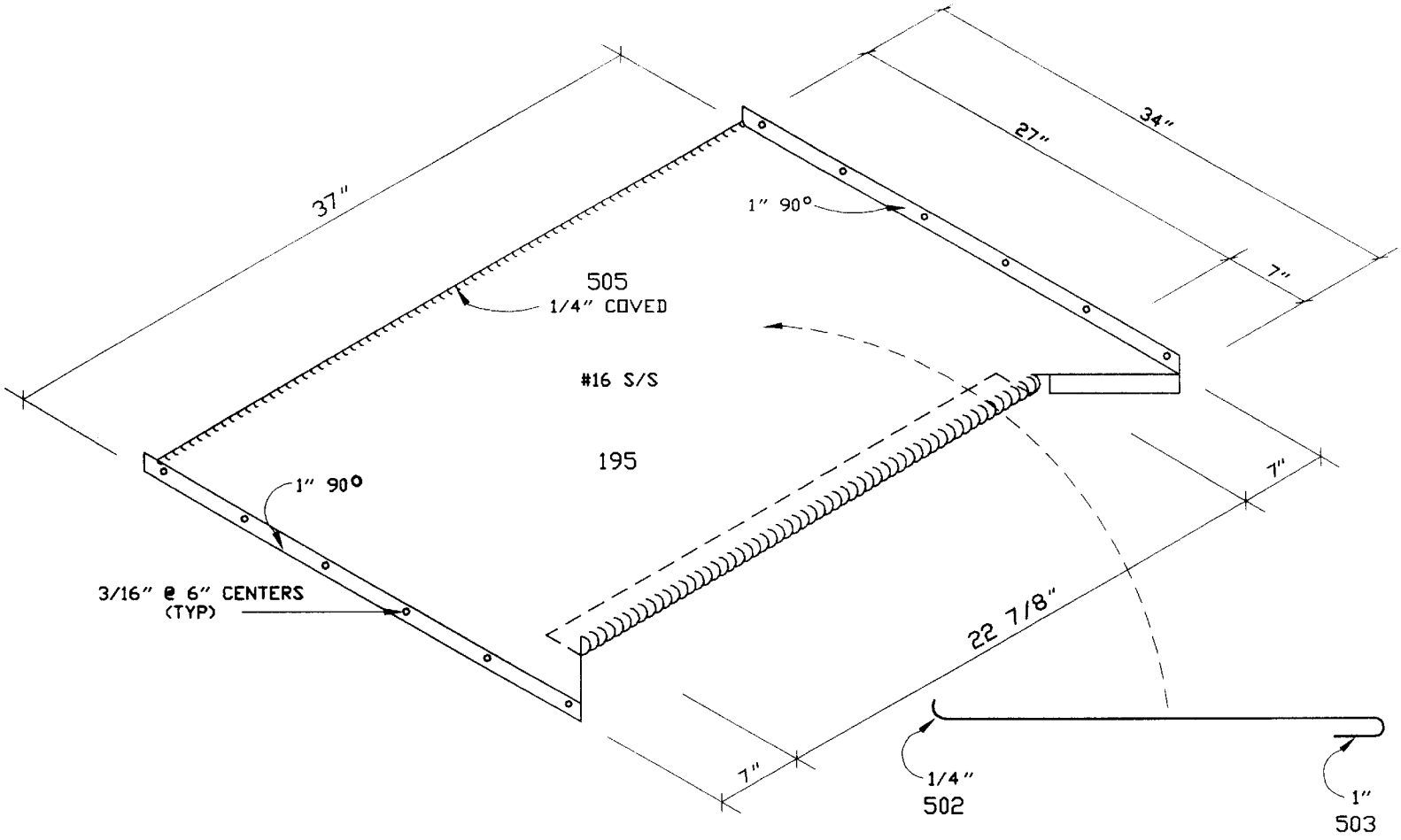

FIGS. 14A and 14B depict in more detail separate parts used to form the plenum in the FIG. 3 embodiment. A left side panel 510 comprises plenum side panel 196 and plenum air wall 193 in the dimensions indicated in FIG. 14A. A right side panel 511 comprises a plenum side panel 197 and a plenum air wall 194 in the dimensions indicated in FIG. 14A. The plenum ceiling plate 195 is constructed in the dimensions indicated in FIG. 14B. The particular angle of each of the plenum air walls 193, 194 with the respective side housing wall 155, 154 is approximately 42.5 degrees. While preferred dimensions are shown in FIGS. 14A and 14B, other dimensions may be suitable, according to the application and the amount of air compression desired. Experiment has shown that the plenum construction of FIGS. 14A and 14B results in up to 10,000 cubic feet per minute (CFM) or more of air flow for a 2-horsepower fan 170.

The plenum air walls 193, 194 preferably comprise relatively straight metal panels as shown in FIG. 14A, and therefore provide compression of the air in a generally linear manner. Alternatively, the plenum air walls 193, 194 may be of some other suitable shape, such as semi-curved. However, the FIG. 14A design should provide the least amount of turbulence, and is therefore preferred. Also, the plenum air walls 193, 194 in FIG. 14A are relatively simple to manufacture, as compared with, e.g., curved or other alternative designs.

The bottom of each side panel 510, 511 includes coving 501 at about one-quarter inch intervals. The plenum ceiling plate 195 likewise has coving 504, 505 on its front and back rims, respectively. Coving is generally desirable in food applications, and may be required by health and safety standards to facilitate cleaning and prevent bacterial accumulation. The ceiling plate 195 also has a small back lip 502 (of about a quarter inch) and a U-shaped front lip 503 (of about an inch), as shown in FIG. 14B.

Experiment has shown that, with the plenum design of FIGS. 14A and 14B, and the general chamber design shown in FIGS. 3 through 6, the difference in air flow and temperature is minimal between upper and lower trays 163 on an inserted rack 162. Air flow differential between upper and lower trays 163 is less than 50 cubic feet per minute (CFM), while temperature differential tends to be about two degrees or less.

Figure 15A:
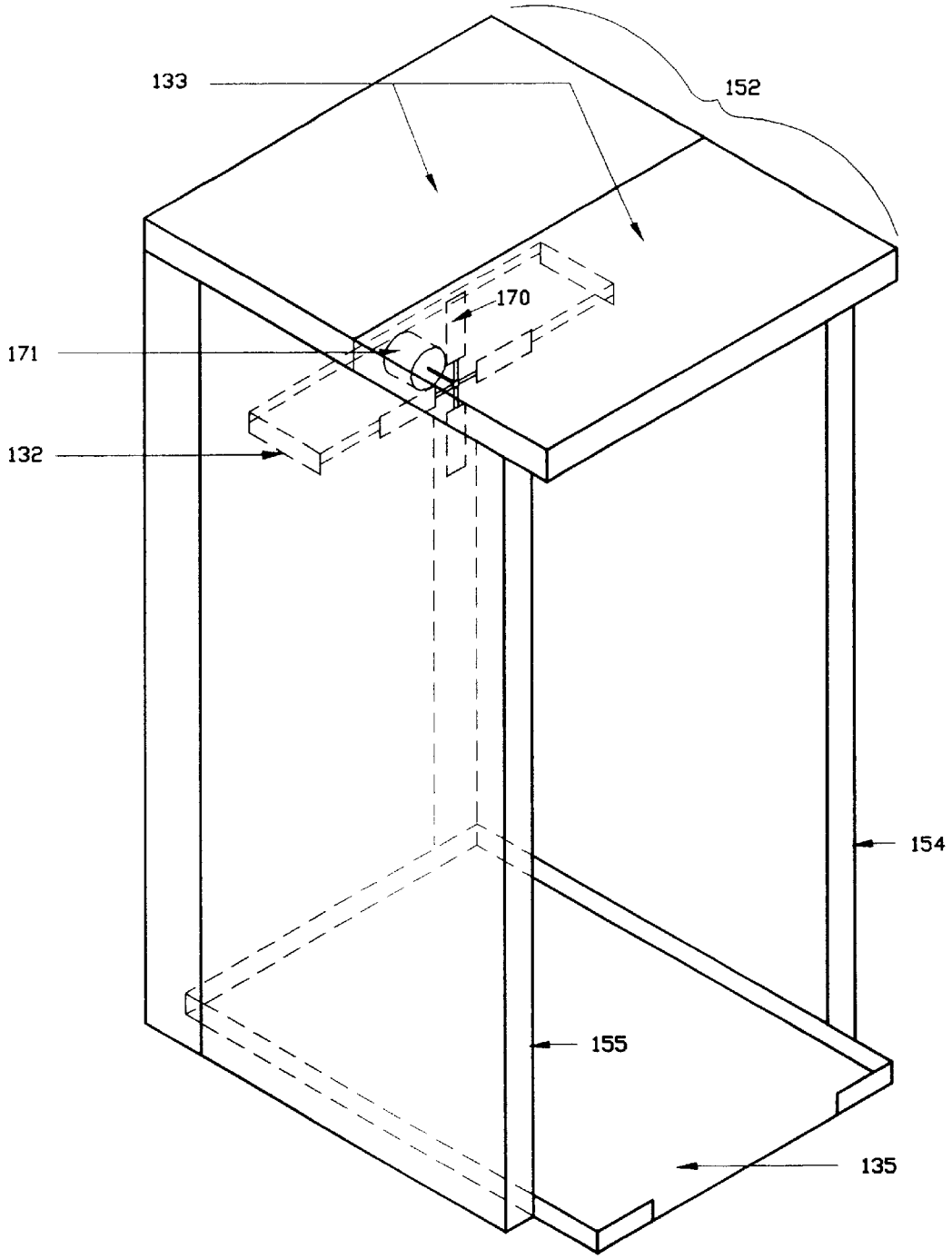
FIGS. 15A–15C are isometric views of a preferred blast chiller showing the relative placement of interior components and features.
Figure 15B:
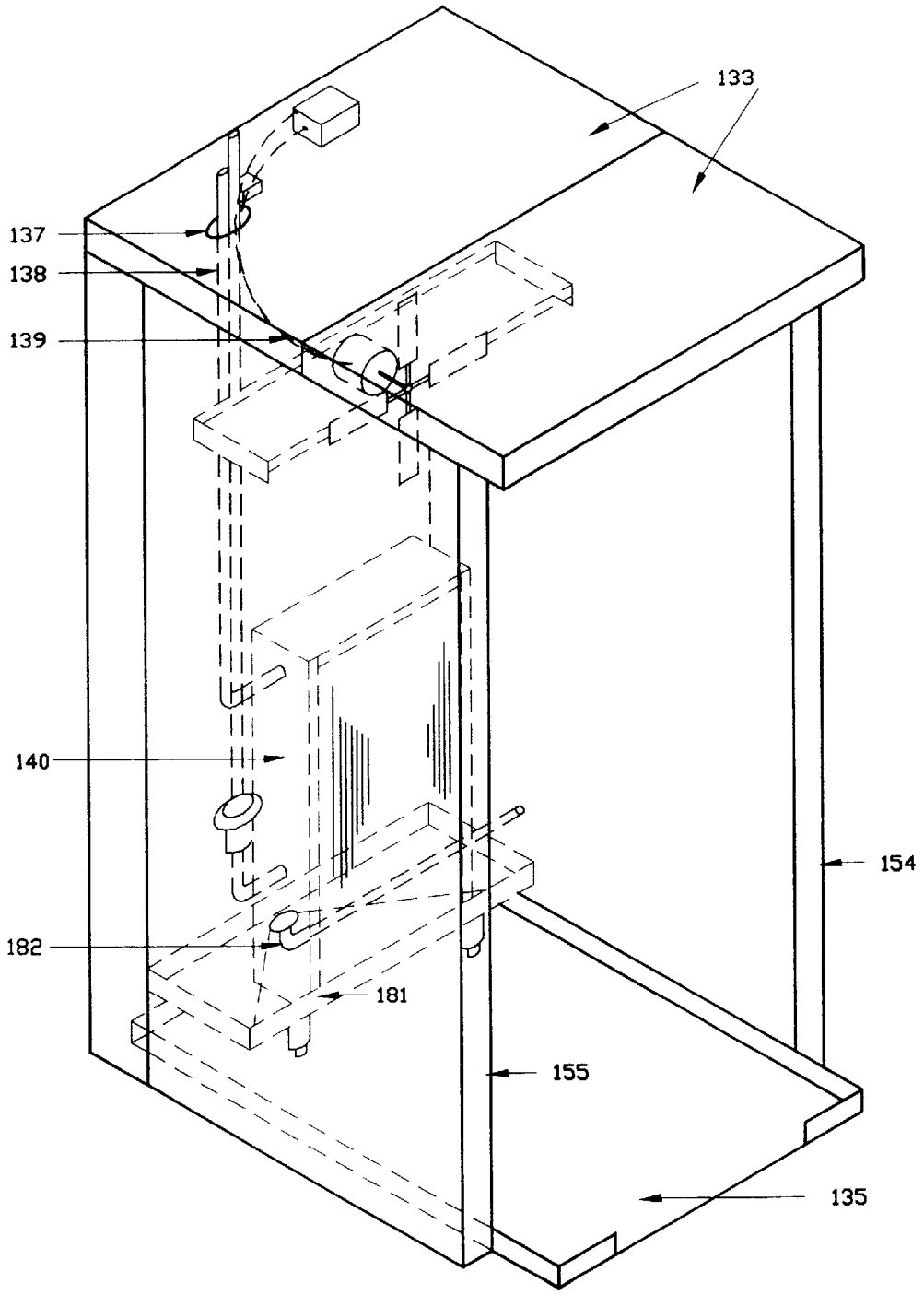
Figure 15C:
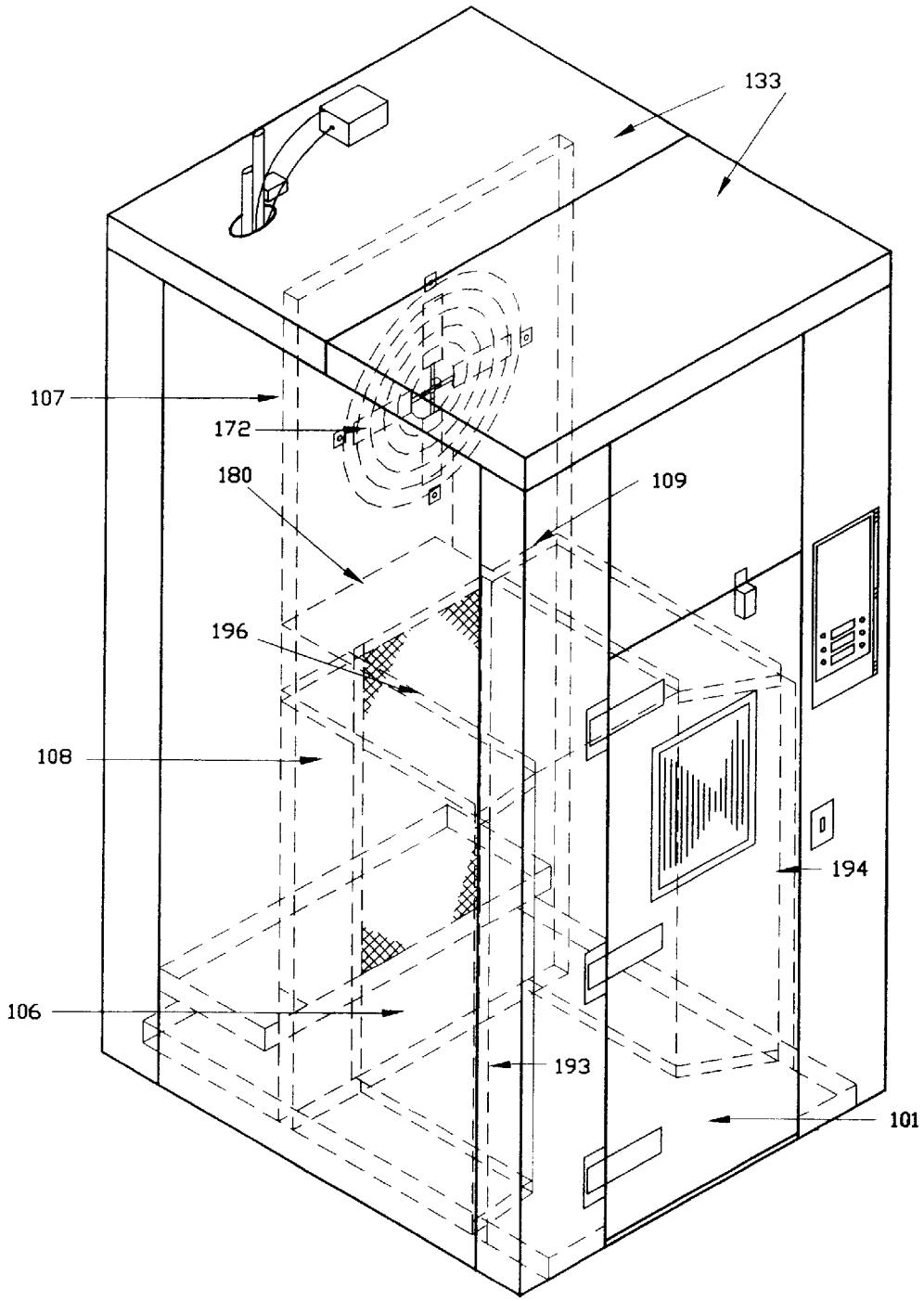

FIGS. 15A through 15C are isometric views of the FIG. 3 embodiment, and show the relationship between the internal components and features of the FIG. 3 blast chiller. FIG. 15A shows the basic housing side walls 154, 155, between which is placed a floor pan 135 which may be constructed, e.g., of 14-gauge stainless steel. The housing ceiling 152 may be constructed of two individual ceiling panels 133 as shown in FIG. 15A. A mounting bracket 171 may be positioned between the two housing side walls 154, 155 to facilitate mounting of the fan 170.

FIG. 15B shows the relative position of the evaporator 180 towards the back of the blast chiller chamber, and the suction header 140 to one side of the evaporator 180. A penetration hole 137 is located in one of the ceiling panels 133 to allow entry of suction and liquid lines 138. A fan motor control line 139 may also be run through the penetration hole 137. FIG. 15C shows the relative location of the various plenum panels, including the plenum air panels 193 and 194, the plenum side panels 196, 197, the plenum ceiling plate 195, and plenum back air panels 108, 109. In addition, a low pressure cavity top panel 107 is shown, with a cut-out hole over which the fan guard 172 is positioned. A bottom panel 106 may be positioned behind the plenum area, in front of or immediately below the drain pan 181 (see FIG. 15B).

Figure 11A:
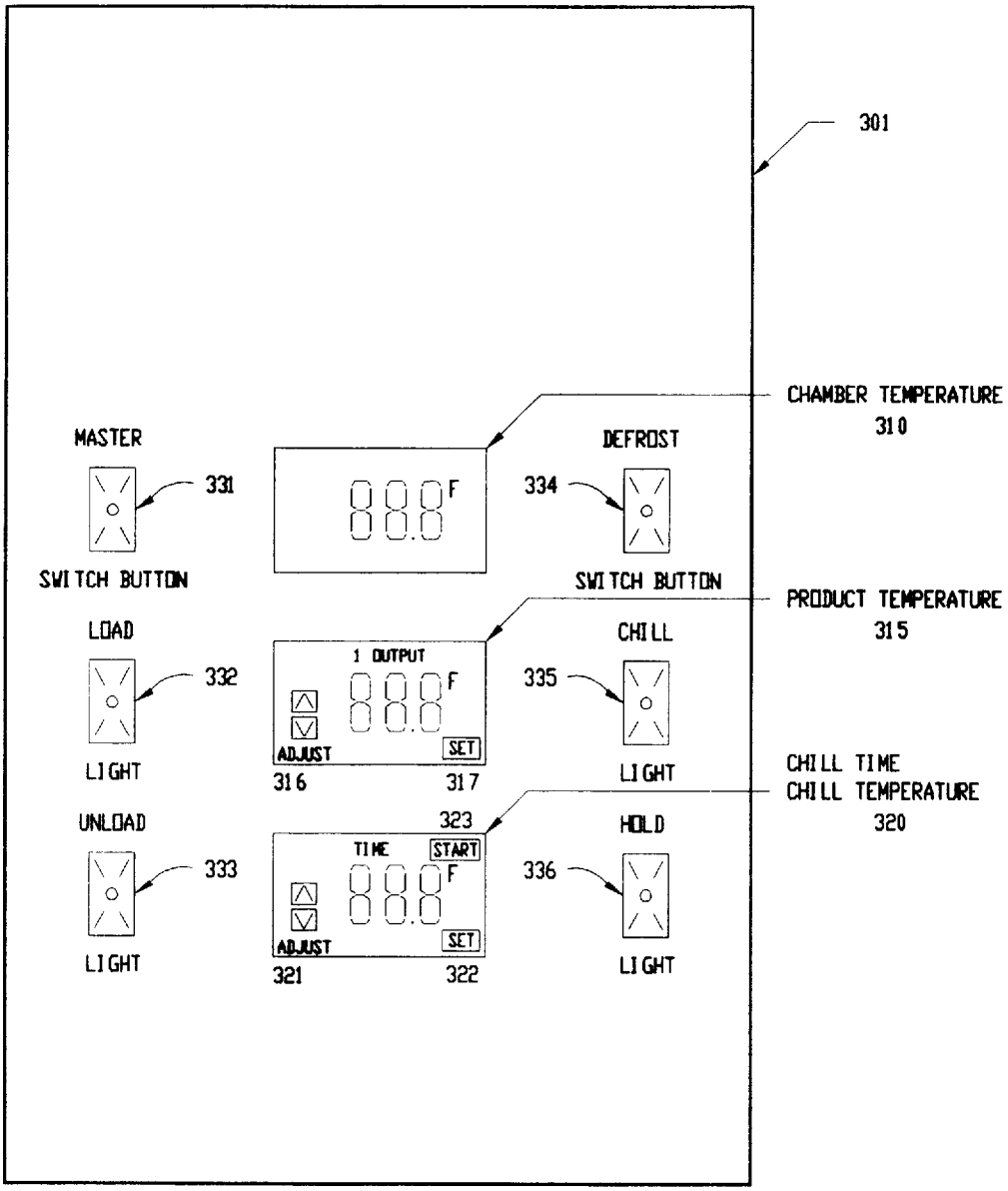
FIG. 11A is a diagram of a control panel enabling selection of command parameters.

FIG. 11A is a diagram of a control panel 301 (such as control panel 102 depicted in FIG. 3) for controlling various operating parameters of the blast chiller. The control panel 301 is preferably a solid state device for controlling both temperature and chill time, as well as monitoring interior chamber temperature. The control panel 301 has a chamber temperature display unit 310 comprising an LED display. An interior sensor (as commonly used in the art) is located in the blast chiller chamber, and provides a chamber temperature measurement which is displayed on the chamber temperature display unit 310.

The control panel 301 further comprises a product temperature display unit 315 and a chill time/temperature display unit 320, each with membrane-touch adjustment buttons 316 and 321, respectively, and set buttons 317 and 322, respectively. The product temperature display unit 315 and chill time/temperature display unit 320 each may comprise an LED display. The control panel 301 also comprises a master switch button 331, a defrost switch button 334, a load light 332, an unload light 333, a chill light 335, a hold light 336, and a start button 323. In operation, the master switch button 331 is activated to commence a pre-cooling cycle which cools the blast chiller chamber down to a preset temperature (e.g., 36 degrees). This process ordinarily takes several minutes. Once the chamber is cooled down, the product to be cooled (which may be placed in, e.g., 2½" deep stainless steel pans) is placed on the rack or cart 162. An interior stainless steel insertion probe with a temperature sensor may be inserted into the core of the product, and thereby provide an ongoing temperature indication of the product to be cooled.

After the product is placed in the chamber and the door 101 closed, the target product temperature may be set to a default value, and displayed on the product temperature display unit 315. If the user desires a different target product temperature, then the default target product temperature may be changed by pressing the set button 317 for the product temperature display unit 315. The target product temperature may be selected by pressing the up and down arrow adjustment buttons 316, while the selected temperature appears on the product temperature display unit 315. In one embodiment, the target product temperature is selectable between 300 degrees and −66 degrees Fahrenheit. When the target product temperature is reached, the set button 317 may be depressed again to store the new target product temperature in memory. Thereafter, the actual product temperature (as measured by the internal probe and sensor) may be displayed on the product temperature display unit 315.

The chill time and chill temperature may also be preset to default values, and may be changed from the default values using the control panel 301. Pushing the set button 322 displays the default chill temperature, which is the temperature to be maintained inside the blast chill chamber (typically +36 to −25 degrees Fahrenheit). If the user desires a different chill temperature, then the default chill temperature may be changed by pressing the set button 322 for the chill time/temperature display unit 320. The chill temperature (i.e., chamber air temperature) may be selected by pressing the up and down arrow adjustment buttons 321, while the selected chill temperature appears in the chill time/temperature display unit 320. When the desired target chill temperature is displayed, the set button 322 may be depressed again so as to display the default chill time. The chill time may likewise be altered by pressing the up and down arrow adjustment buttons 321. The new chill temperature and chill time may be stored in memory by pressing the set button 322 again.

After the various operating parameters have been selected, the start button 323 may be depressed, which commences the chilling operation. The chill light 335 goes on during the chilling operation. When the target product temperature is reached (as sensed by the internal probe and sensor), the chilling operation is suspended, and the hold light 336 activates to indicate entry into a hold cycle. During the hold cycle, the product temperature is maintained at the target product temperature by a straightforward temperature feedback control loop.

If the chill time timer reaches zero minutes before the target product temperature is reached, two different options are possible. In one embodiment, the chilling operation enters a hold cycle, and the unload light 333 activates. In the hold cycle, no further chilling is conducted. In another embodiment, when the chill time timer reaches zero minutes before the target product temperature is reached, the chilling operation continues until the target product temperature is met. Once met, a hold cycle is entered, which maintains the chamber and product at the target product temperature, and activates the unload light 333.

A defrost mode may optionally be provided for manual activation. The defrost mode may be activated prior to or after the chilling operation.

In a particular embodiment, the control panel 301 is under control of a microprocessor or other type of microcontroller. A temperature recorder (not shown) may be mounted on or near the blast chiller to allow recording (in the form of a printout) of the product temperature on a continuous basis over a time period. The temperature recorder may interface to the microprocessor with a serial port interface and memory buffer. Alternatively, the temperature recorder may be independent of the blast chiller controller. A suitable temperature recorder is manufactured by Weksler Corporation. The temperature recorder may have its own independent temperature probe. The printout provided by the temperature recorder may be used as evidence, where required, that official regulations or health standards have been met for a particular cook-chill operation.

Figure 11B:
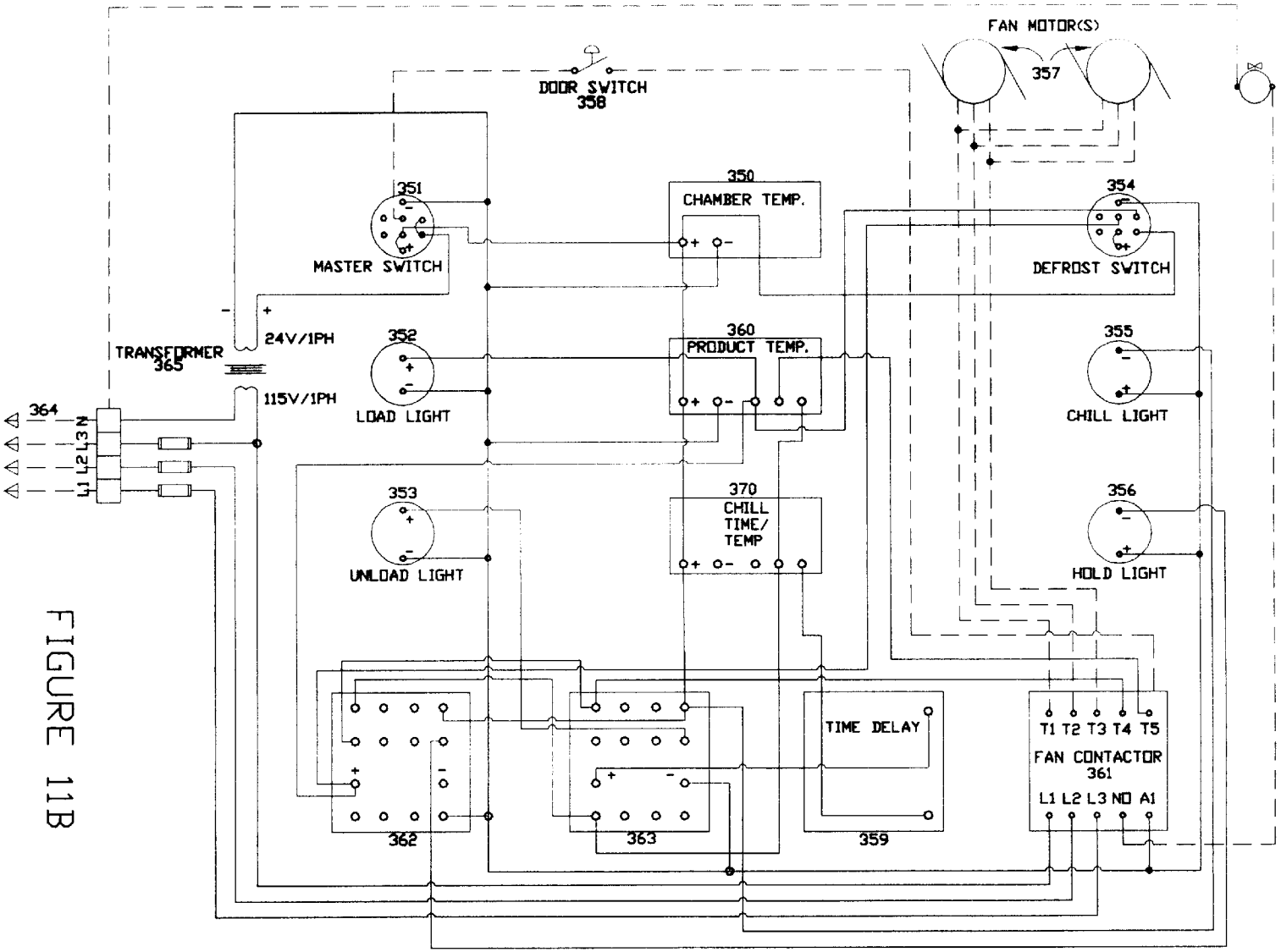
FIGS. 11B and 11C are circuit diagrams associated with the control functions.

FIG. 11B is a circuit diagram in accordance with one embodiment of the present invention illustrating connections between various components associated with control functions. FIG. 11B is drawn with standard engineering symbols and terminology. In FIG. 11B is shown a chamber temperature monitor 350, a product temperature controller 360, and a chill time/temperature controller 370. The chamber temperature monitor 350 receives from a sensor a reading of the chamber temperature and displays it. The chamber temperature controller 350, the product temperature controller 360, and the chill time/temperature controller 370 are connected as shown to master switch connections 351, load light connections 352, unload light connections 353, defrost switch connections 354, chill light connections 355, hold light connections 356, and fan contactor 361. The fan contactor 361 is connected to the fan motors 357. A door switch 358 is connected to the master switch 351 and the fan contactors 361, and inhibits the chill operation when the door 101 (see FIG. 3) is ajar. Relays 362 and 363 may be opened or closed as necessary under control of the chamber temperature controller 350 or the product temperature controller 360. Control lines 364 are connected from the control panel to the various automated components. The master switch 351 is isolated from the control lines 364 by a transformer 365.

Figure 11C:
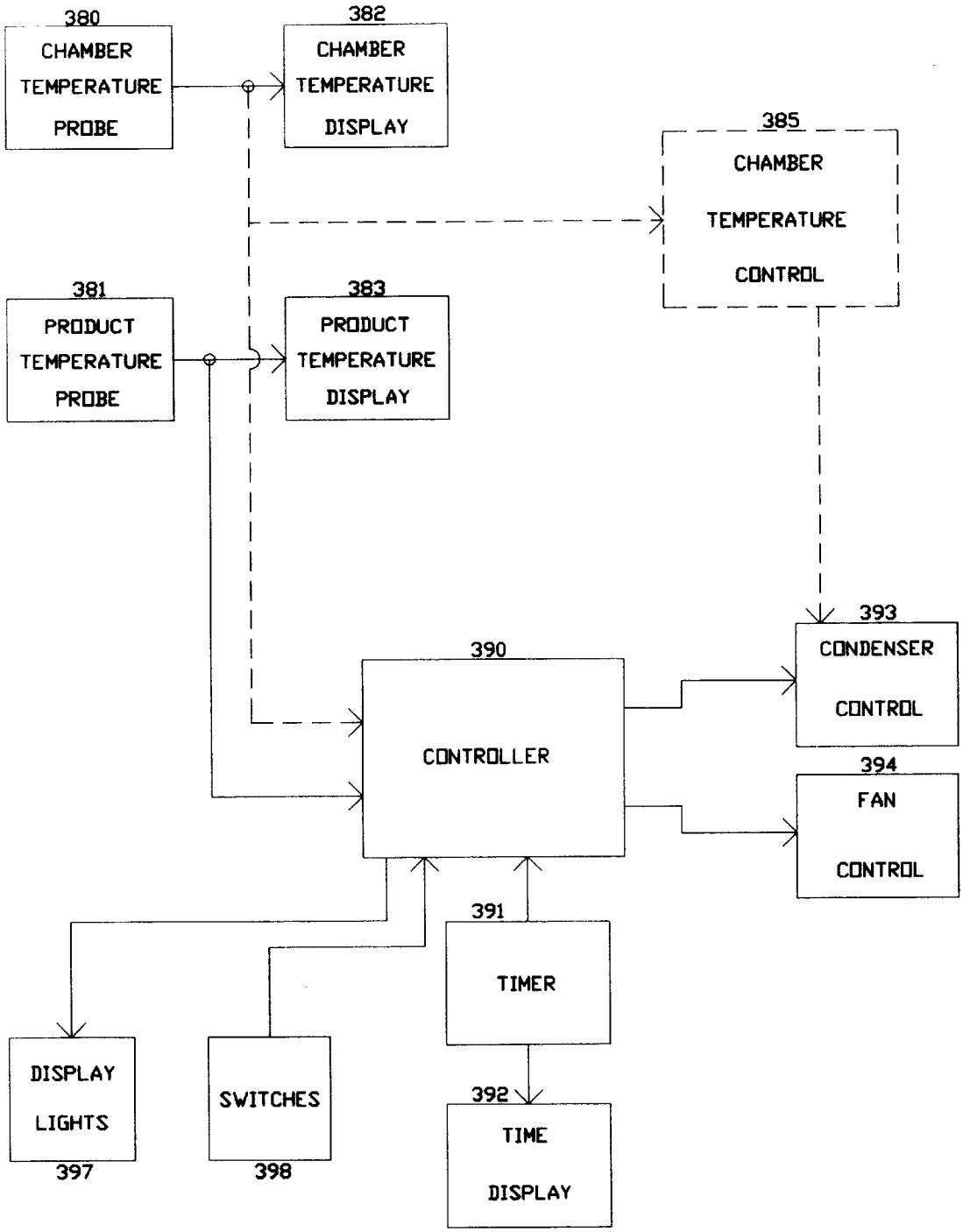

FIG. 11C is a functional block diagram of a particular embodiment generally in accordance with the diagrams of FIGS. 11A and 11B. In FIG. 11C, a chamber temperature probe 380 monitors the chamber temperature and is connected to a chamber temperature display 382 (such as chamber temperature monitor 310 shown in FIG. 11A). A product temperature probe 381 monitors the product temperature and is connected to a product temperature display 383 (such as product temperature display unit 315 shown in FIG. 11A). The product temperature probe 381 may be a model TS-10PTC-ELT-01 temperature sensor as manufactured by Control Products, Inc., which sensor is an 8" by 0.25" stainless steel probe with a 4" handle and having a temperature range of 67 degrees to 302 degrees Fahrenheit. The tip of the product temperature probe 381 is preferably inserted into the core of the product during chilling operations.

A controller 390 receives as an input the product temperature as monitored by the product temperature probe 381. Optionally, the controller 390 may also receive the chamber temperature as monitored by the chamber temperature probe 381, to allow the controller 390 to regulate the chamber temperature. Alternatively, the system may be configured with an independent chamber temperature control 385, which maintains the chamber temperature at a preset target chamber temperature during chilling operations.

The controller 390 is connected to a timer 391, which may be internal or external to the controller 390. The timer 391 may be set to a target chilling time by the user in a manner as described previously. The timer 391 is connected to a time display 392 (such as chill time/temperature display unit 320 shown in FIG. 11A), which shows the amount of chill time remaining. The controller 390 is connected to either or both of a condenser control 393 and fan control 394, and thereby controls the chilling operation. When a target product temperature or a target chilling time is reached, the controller 390 may suspend the chilling operation by disabling either or both of the condenser and/or the fans. The controller 390 receives inputs from various input switches 398 (e.g., adjustment buttons 316 and 321 and set buttons 317 and 322 shown in FIG. 11A), and sends control signals to the various display lights 397 as mentioned with respect to FIGS. 11A and 11B.

In a particular embodiment, the controller 390 comprises separate local microcontrollers for the product temperature monitoring and control and the chilling time/temperature monitoring and control. Thus, as shown in FIG. 11B, a product temperature controller 360 monitors the product temperature, while the chill time/temperature controller 370 monitors the chill time and temperature. In the event that the target value is reached for either product temperature or chill time, either controller 360 or 370 may place the blast chiller in a hold cycle. To effectuate this capability, the controllers 360 and 370 may each be connected to one of a pair of output switches configured in series, the opening of either of which will cause entry into the hold cycle. In this embodiment, the chill time/temperature controller 370 is responsible for regulating the chamber temperature, and therefore uses a standard temperature feedback control loop to temporarily suspend chilling if the chamber temperature gets too cold (i.e., below the selected chill temperature).

A time delay circuit 359 is connected to the chill time/temperature controller 370, as shown in FIG. 11B. The time delay circuit 359 allows energization of a defrost cycle for an adjustable time frame, prior to the chilling operation. A fifteen minute time frame for the defrost cycle is typical, so as to allow any ice or frost to be cleared off the DX coil before chilling commences.

FIGS. 7–10 collectively depict a second embodiment of a blast chiller in accordance with one or more aspects of the present invention. The embodiment of FIGS. 7–10 is similar to the embodiment of FIGS. 3–6, but allows for the use of multiple carts or racks.

Figure 7:
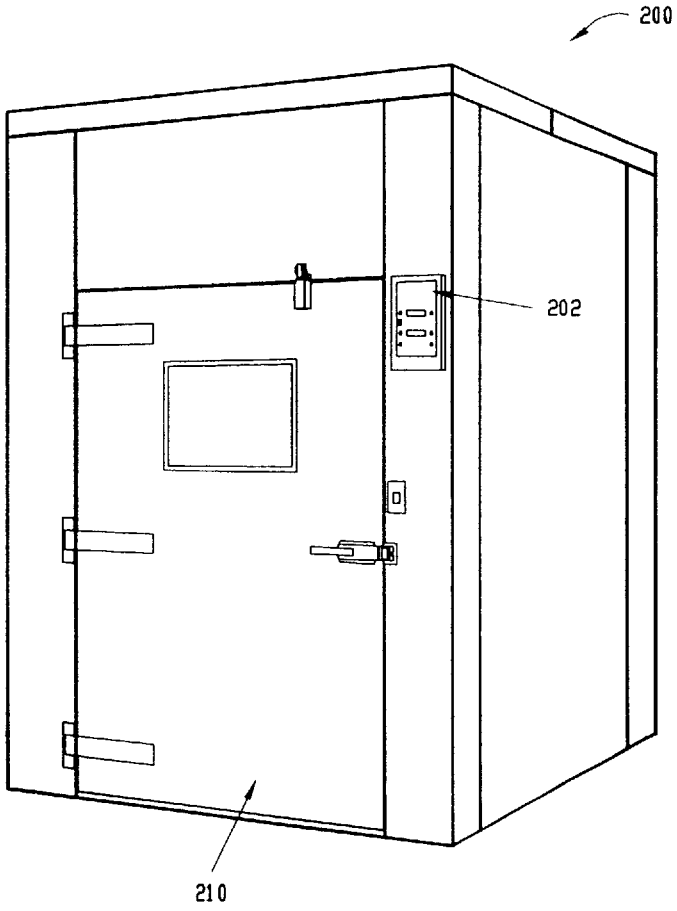
FIG. 7 is an isometric view of a housing of a dual cart blast chiller in accordance with a second embodiment of the present invention.

FIG. 7 is a diagram showing an isometric view of a housing 200 of a dual-cart blast chiller. The housing 200 may be constructed in a manner as described with respect to the housing 100 of FIG. 3—that is, using a durable and sturdy material such as 20-gauge type 304 stainless steel interior and exterior panels with a layer of insulating material (e.g., about four inches of class 1 urethane foam) therebetween.

The housing 200 has a door 201 (or multiple doors) also constructed of stainless steel plates having several inches (e.g., three inches) of class 1 urethane foam therebetween. The door 201 allows insertion in or removal from a blast chiller chamber of carts or racks bearing products to be chilled. A control panel 202 similar to that shown in FIGS. 11A through 11C is attached to the outside of the housing 200 to allow varying of the chilling temperature and time.

Figure 8:
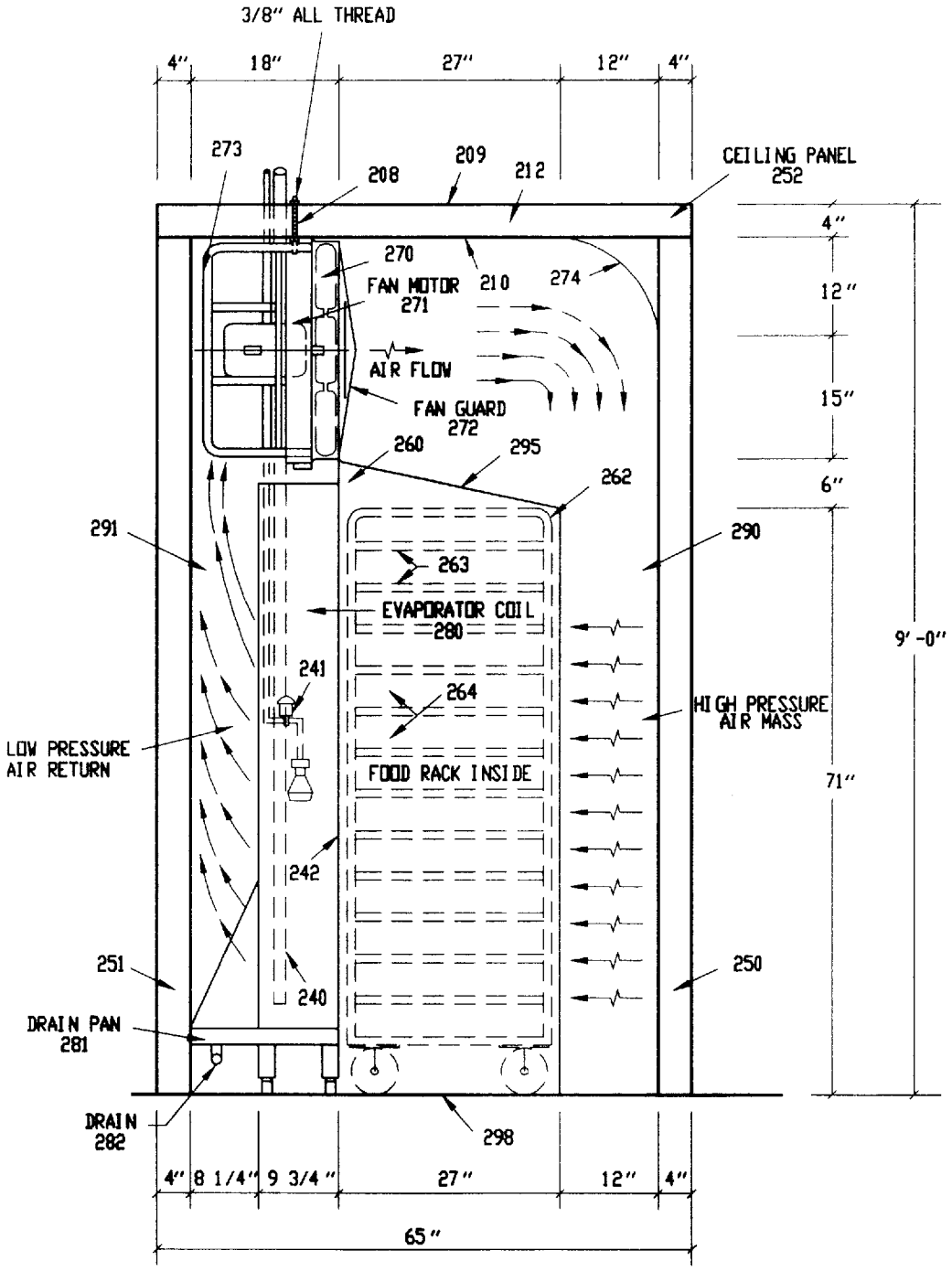
FIG. 8 is a sectional view of the dual cart blast chiller of FIG. 7.
Figure 9:
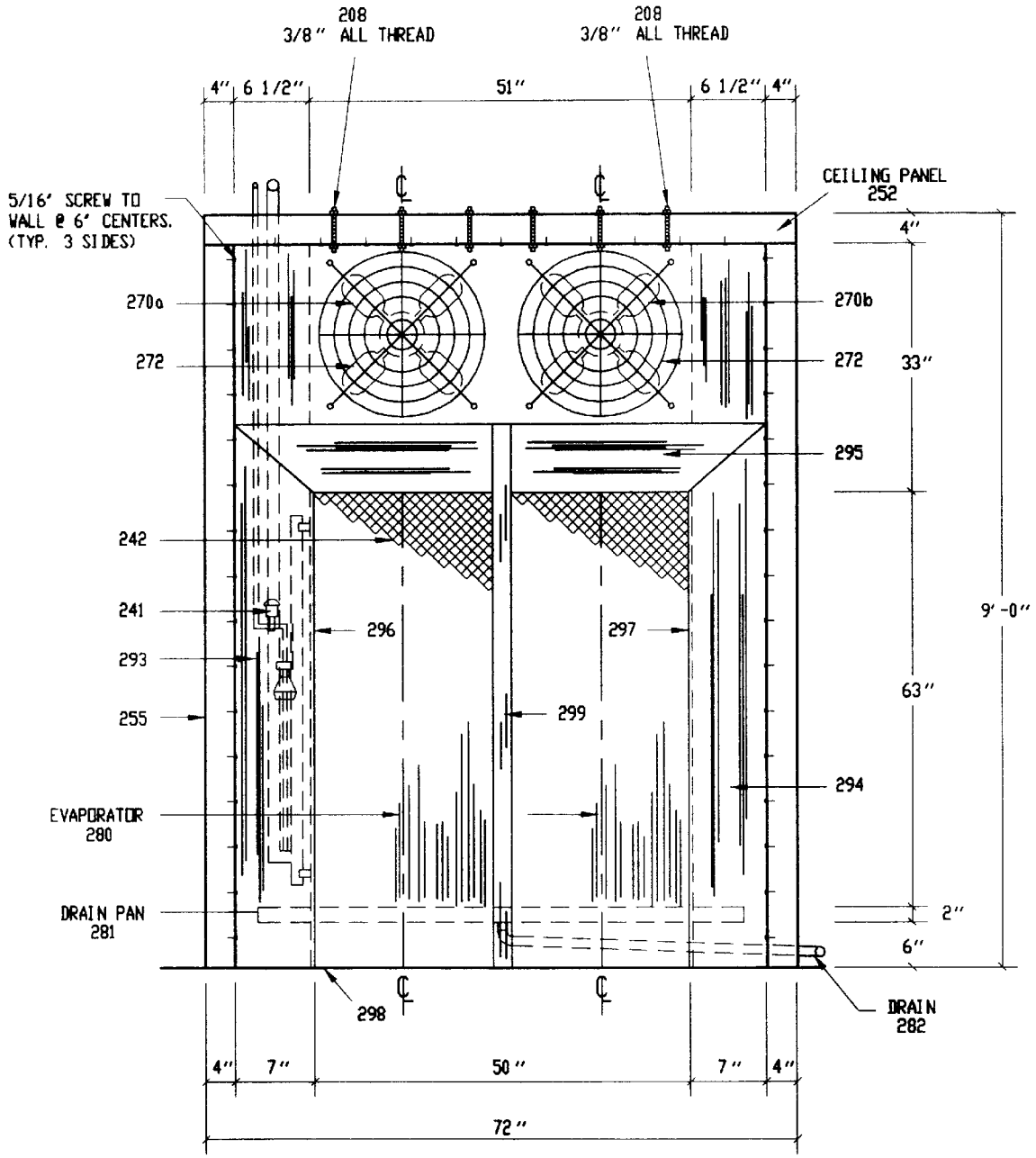
FIG. 9 is a front sectional view of the dual cart blast chiller of FIG. 7.
Figure 10:
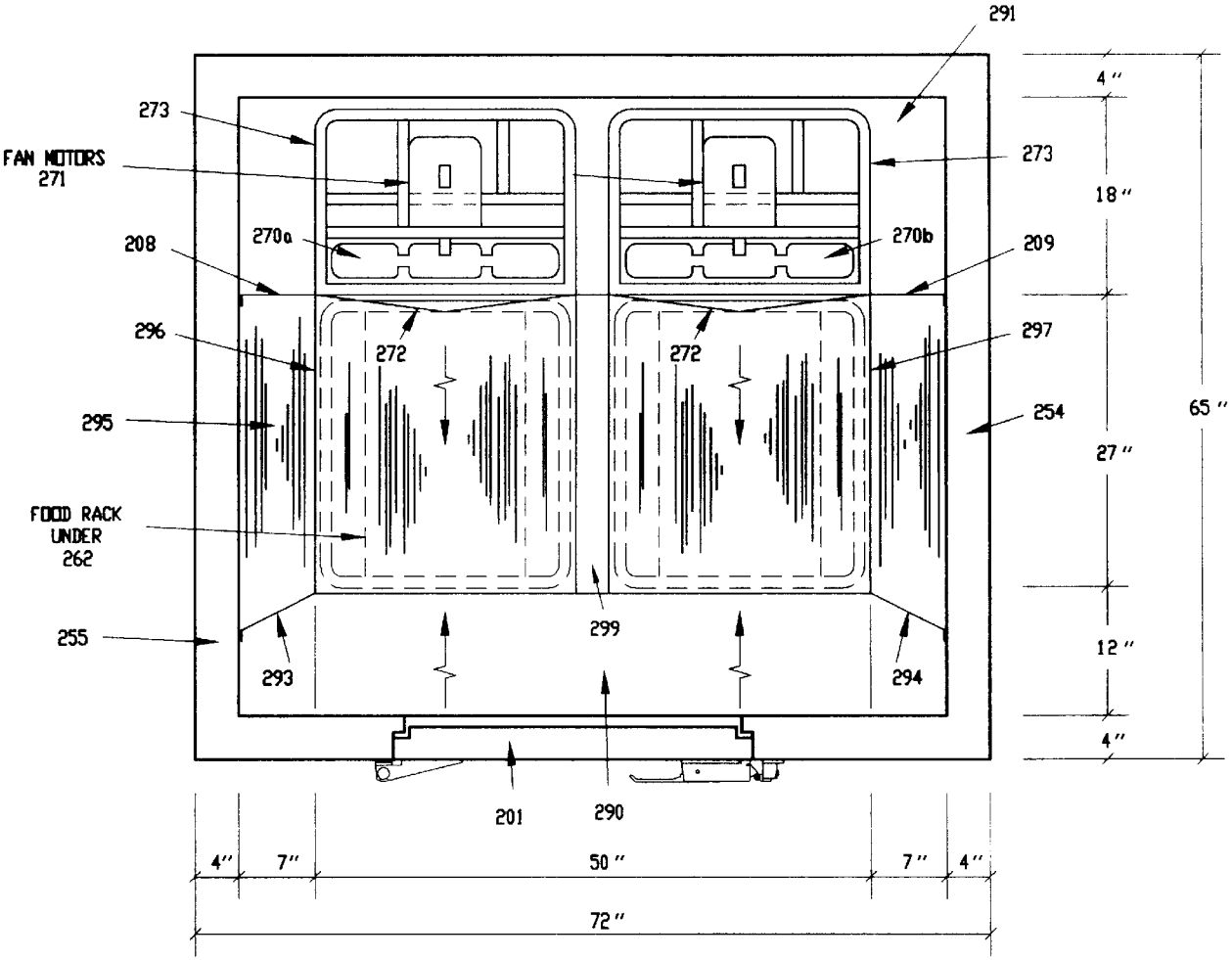
FIG. 10 is a plan view (with open ceiling) of the blast chiller of FIG. 7.

FIGS. 8, 9 and 10 are diagrams showing different views of the internal characteristics of the FIG. 7 blast chiller, similar to FIGS. 4, 5 and 6, respectively, and also showing preferred dimensional characteristics. FIG. 8 is a sectional view; FIG. 9 is a front sectional view; and FIG. 10 is a plan view (with open ceiling). As shown in FIG. 8, the dual-cart blast chiller comprises a front housing wall 250, a rear housing wall 251, and a housing ceiling panel 252. FIGS. 9 and 10 further show side housing walls 254 and 255. The front housing wall 250, rear housing wall 251, housing ceiling panel 252, and side housing walls 254 and 255 are all part of the housing 200 shown in FIG. 7.

The interior of the dual-cart blast chiller in the embodiment shown in FIGS. 8–10 comprises a pressure plenum 260 adapted to receive multiple carts or racks 262 (e.g., two carts or racks) each having a number of shelves or trays 263. The plenum 260 conforms closely to the width dimensions of the multiple carts 262 which are positioned side by side. The plenum 260 is open at front and back ends, and is defined by a floor 298, a pair of plenum side panels 296 and 297, and a plenum ceiling plate 295. The plenum ceiling plate 295 is positioned so that the carts 262 fit underneath it without too much excess room (e.g., about 2 inches) above the top of each cart 262. Likewise, the plenum side panels 296, 297 are constructed so as to conform closely to the width of the several carts 262 placed side by side without too much excess airspace (preferably less than, e.g., 1 inch) between each plenum side panel 296, 297 and the adjacent side of the outer carts 262.

The plenum side panels 296, 297 and plenum ceiling plate 295 are preferably constructed of rigid, durable material such as 16-gauge type 304 stainless steel plating.

A one-inch metal support 299 may be placed between each rack 262. The metal support 299 generally has minimal influence on the air flow pattern.

Above the plenum 260 are positioned a pair of fans 270*a*, 270*b*. The fans 270*a*, 270*b* are powered by fan motors 271 which may each be, e.g., a 2-horsepower electric motor. Each fan motor 271 is connected to its own frame 273 mounted to the ceiling housing panel 252 by suitable fastening means such as ⅜" nylon all-thread rods 208. Each fan 270*a*, 270*b* has its own fan guard 272 located in front of it, and may be aligned so as to be roughly even with the back edge of the inserted carts 262. The fans 270*a*, 270*b* are generally positioned so as to blow air across the top of the plenum ceiling plate 295 and towards the front housing panel 250.

In front of the plenum 260 is a high pressure cavity or chamber 290 generally defined by the front housing wall 250 (including the door 201), the front of the plenum 260, and the two side housing walls 254, 255. Air is directed from the high pressure cavity 290 in a funnel-like manner into the plenum 260 by the plenum air walls 293 and 294, which taper from the side housing walls 254, 255 to the plenum side panels 296, 297. The effect of the tapered plenum air walls 293, 294 is similar to those of the FIG. 3 embodiment described previously.

Behind the plenum 260 is a low pressure cavity or chamber 291 generally defined by the rear housing wall 251, the rear of the plenum 260 (including plenum back air walls 208 and 209), and the two side housing walls 254, 255 (or, alternatively, extensions of the plenum side panels 296, 297 instead of the two side housing walls 254, 255). Low pressure is maintained in the low pressure cavity 291 by the suction action of the fans 270*a*, 270*b*, and is also created by expansion in width from the plenum 260 to the low pressure cavity 291.

Cooling of the air inside the blast chiller is provided by an evaporator 280 and an air cooled or water cooled condensing unit (not shown) situated outside the blast chiller chamber, together with operation of the fans 270*a*, 270*b* for circulating the air. The evaporator 280 may circulate any suitable coolant such as, e.g., R-22. Circulating coolant evaporates due to transfer of thermal energy from air heated by the hot product on the rack 262 to the evaporator 280. The evaporated coolant circulates through the external condensing unit, wherein it condenses and transfers its thermal energy to the medium outside the blast chilling chamber. The evaporator 280 also serves to maintain suitable humidity in the blast chiller chamber, in a manner similar to that described above with respect to the FIG. 3 embodiment. Condensation dripping from the evaporator 280 or elsewhere is collected in a drain pan 281, and thereafter is released out of a drain 282.

Similar to the FIG. 3 embodiment, the design of the plenum 260 and associated interior chamber structure of the FIG. 7 embodiment is intended to enhance air velocity across the trays 263 of the food rack 262 and maintain evenness of air flow. The fans 270*a*, 270*b* are situated above the racks 262, and disposed to one side of the chamber, so that the air out of the fans 270*a*, 270*b* is allowed sufficient space to develop and close out its initial vorticity. A turning vane 274 helps to direct the air flow downward into the high pressure chamber 290 without causing the turbulence associated with sharp, 90-degree corners.

The configuration of the fans 270*a*, 270*b* also creates a pressure differential across the food racks 262 in the direction of the air flow. This pressure differential helps pull the air out of the spaces 264 between the trays 263 and provides uniformity of air flow across the trays 263. The plenum 260 serves to guide and channel the air blown by the fans 270*a*, 270*b* into the spaces 264 between the trays 263. In particular, the tapered plenum air walls 293, 294 compress the air flow and target the air into the plenum 260, and consequently into the spaces 264 separating the trays 263. The plenum 260 in the FIG. 7 embodiment also helps minimize turbulence and separation of flow as the air enters the spaces 264 between the trays 263.

The relative positioning of elements and features for the FIG. 7 embodiment is similar to that shown for the FIG. 3 embodiment shown in FIGS. 15A through 15C.

Figure 14C:
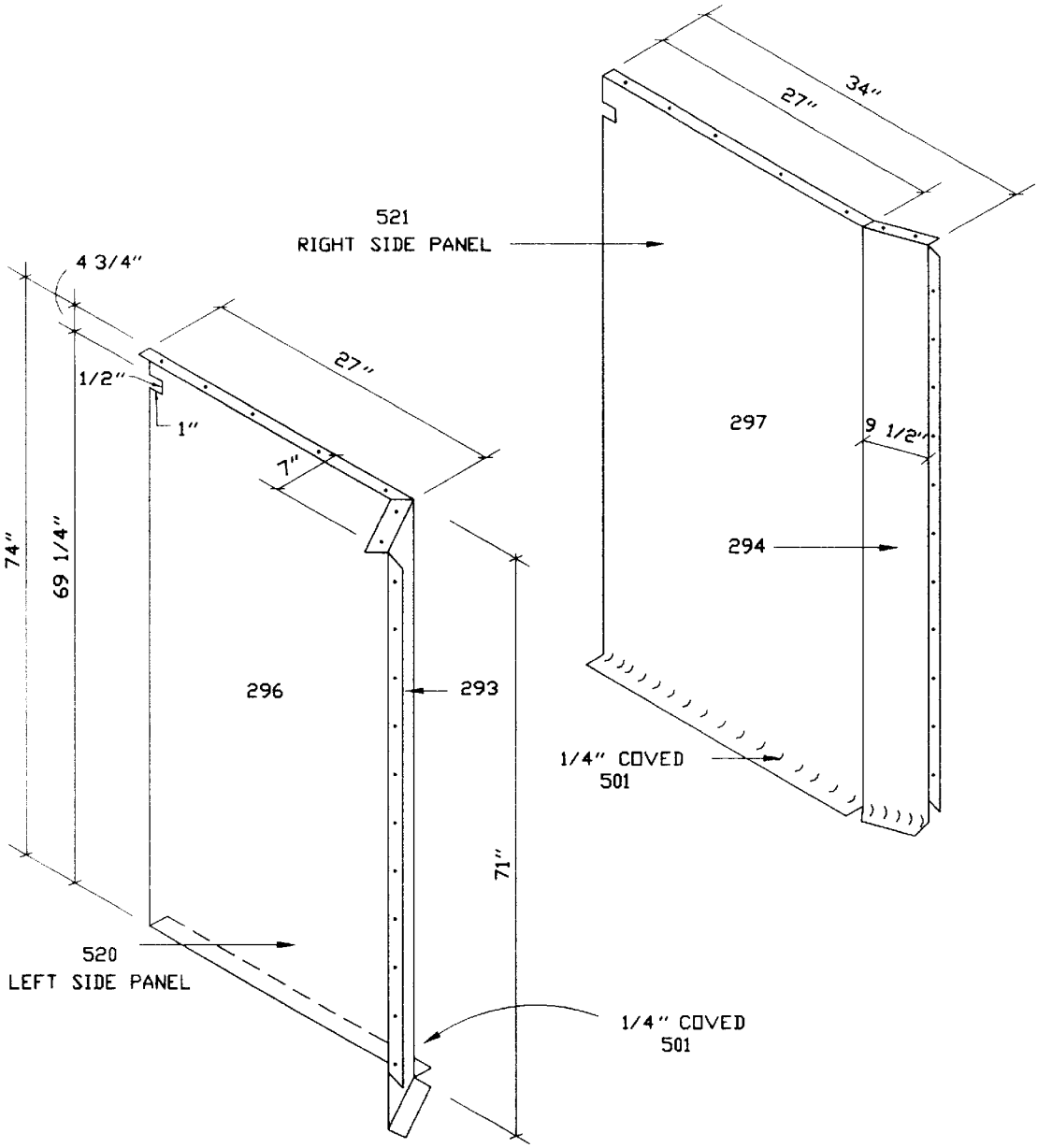
FIGS. 14C and 14D are diagrams of components used to form the plenum area shown in the FIG. 7 embodiment.
Figure 14D:
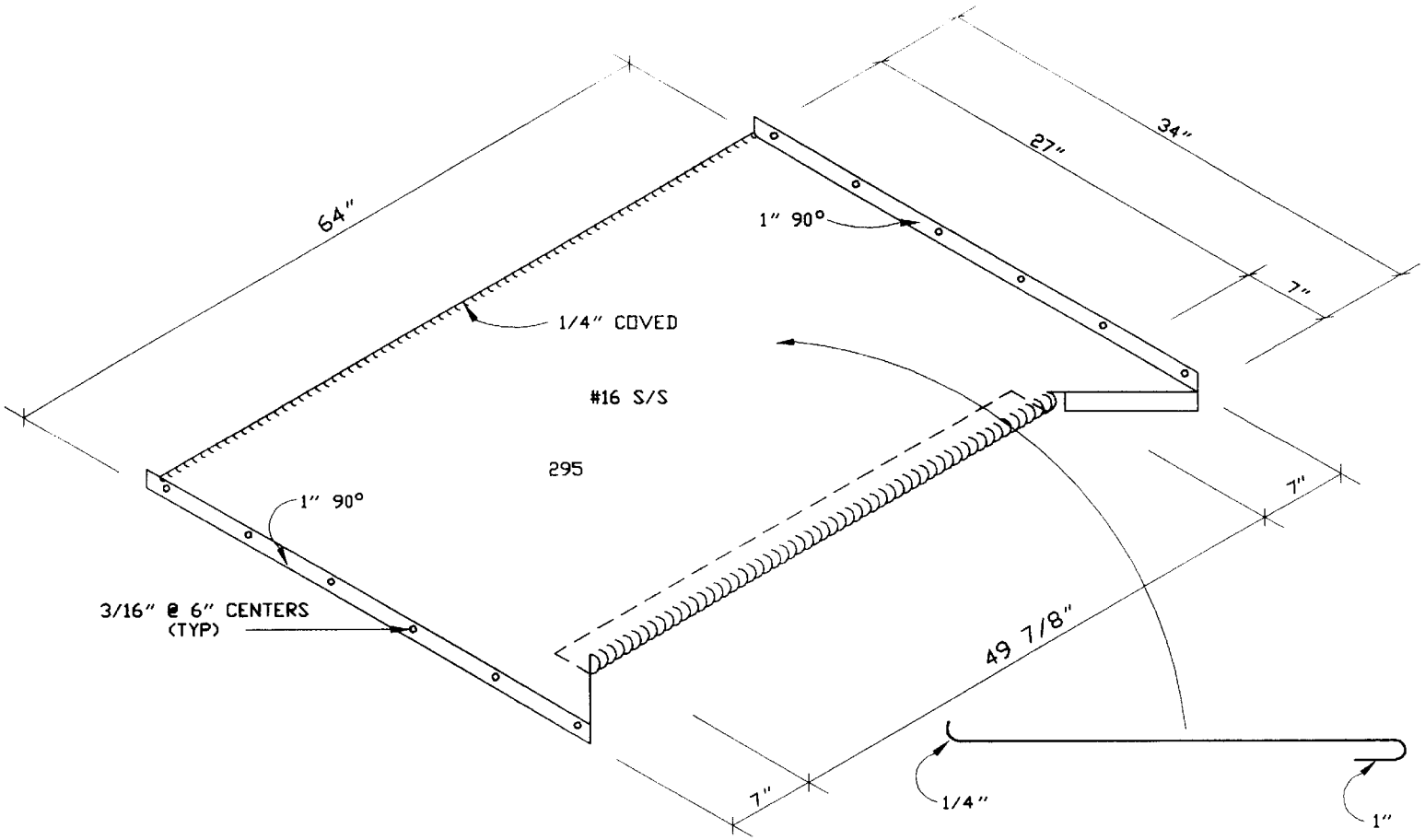

The plenum 260 may be constructed in a manner as shown and described previously with respect to FIGS. 14A and 14B, except that the width dimension is suitably enlarged to accommodate multiple carts or racks 262. FIGS. 14C and 14D depict in more detail separate parts used to form the plenum in the FIG. 7 embodiment. A left side panel 520 comprises plenum side panel 296 and plenum air wall 293 in the dimensions indicated in FIG. 14C. A right side panel 521 comprises a plenum side panel 297 and a plenum air wall 294 in the dimensions indicated in FIG. 14C. The plenum ceiling plate 295 is constructed in the dimensions indicated in FIG. 14D. The particular angle of each of the plenum air walls 293, 294 with the respective side housing wall 255, 254 is approximately 42.5 degrees. While preferred dimensions are shown in FIGS. 14C and 14D, other dimensions may be suitable, according to the application and the amount of air compression desired.

As noted for the FIG. 3 embodiment, the plenum air walls 293, 294 preferably comprise relatively straight metal panels as shown in FIG. 14C. The bottom of each side panel 520, 521 includes coving in a manner similar to the side panels 510, 511 shown in FIG. 14A. The plenum ceiling plate 295 likewise has coving on its front and back rims.

Figure 17A:
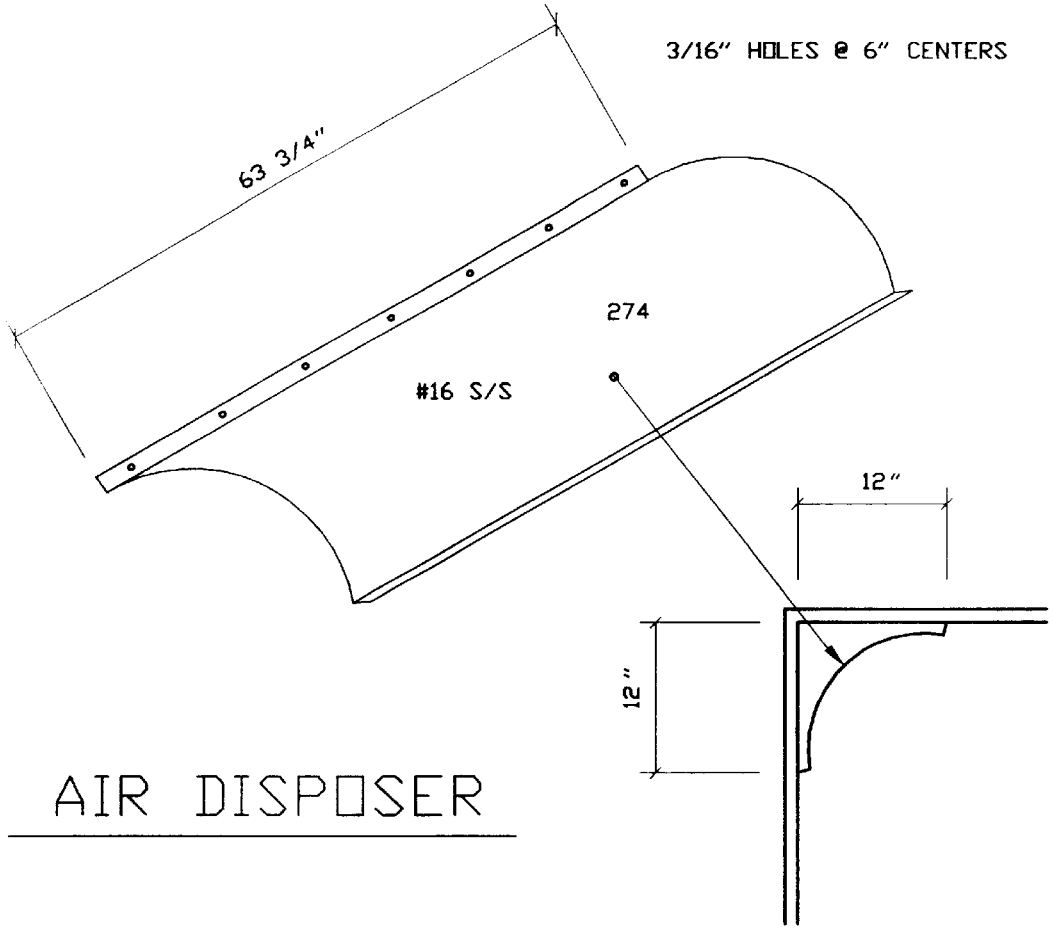
FIGS. 17A through 17D are diagrams showing preferred dimensions of various components of the embodiments shown in FIGS. 7 through 10, such components including a turning vane, fan motor support, drain pan cover and drain pan.
Figure 17B:
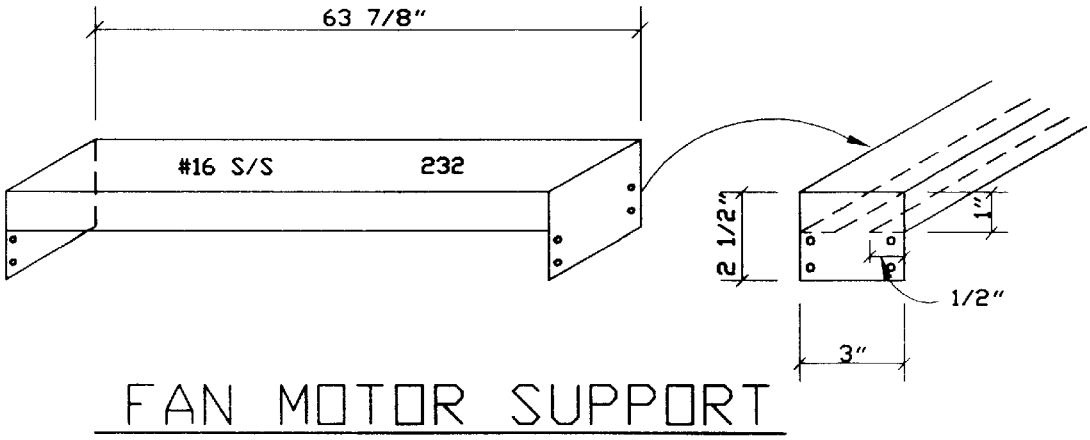
Figure 17C:
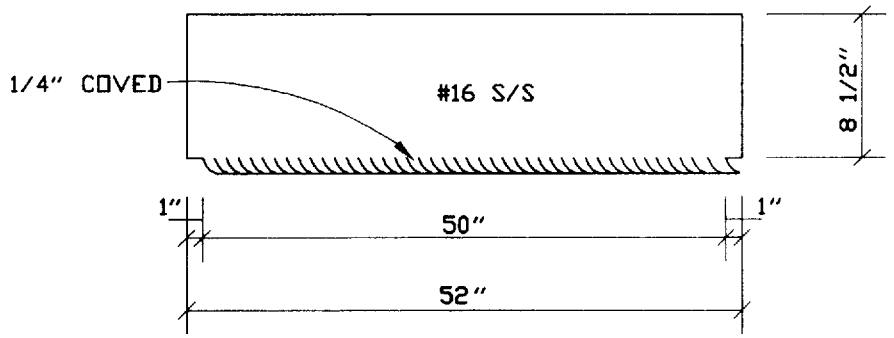
Figure 17D:
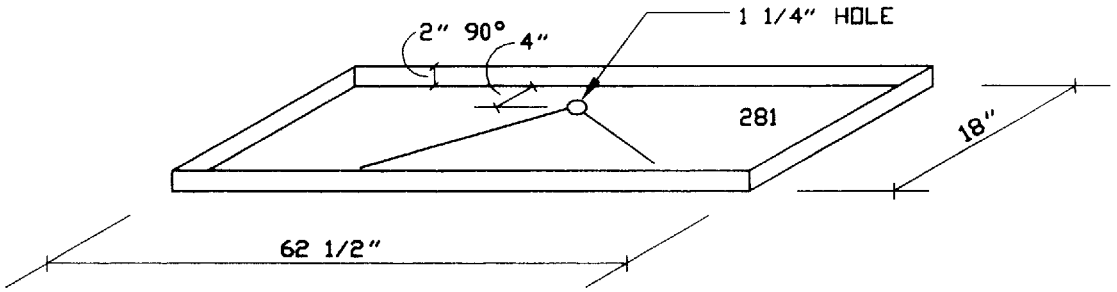

FIGS. 17A through 17D are diagrams showing preferred dimensions of certain components for the embodiment of FIGS. 7–10. FIG. 17A is a diagram of the turning vane 274 (also called an air disposer) such as shown, for example, in FIG. 8. FIG. 17B is a diagram of a fan motor support 232 similar to that shown in FIG. 15A (fan motor support 132) for the FIG. 3 embodiment. FIG. 17D is a diagram of a drain pan 281 such as shown in FIG. 8, and FIG. 17C is a diagram of a drain pan cover 283 such as may be positioned over the portion of the drain pan 281 extending into the low pressure cavity 291. Similar components to those shown in FIGS. 17A–17D are present in the FIG. 3 embodiment, except that the dimensions are adjusted to fit the single-rack design of FIG. 3.

ALTERNATIVE EMBODIMENTS

The present invention has been set forth in the form of its preferred embodiments. It is nevertheless intended that modifications to the disclosed chilling techniques may be made by those skilled in the art without departing from the scope and spirit of the present invention. Moreover, such modifications are considered to be within the purview of the appended claims.

Figure 13:
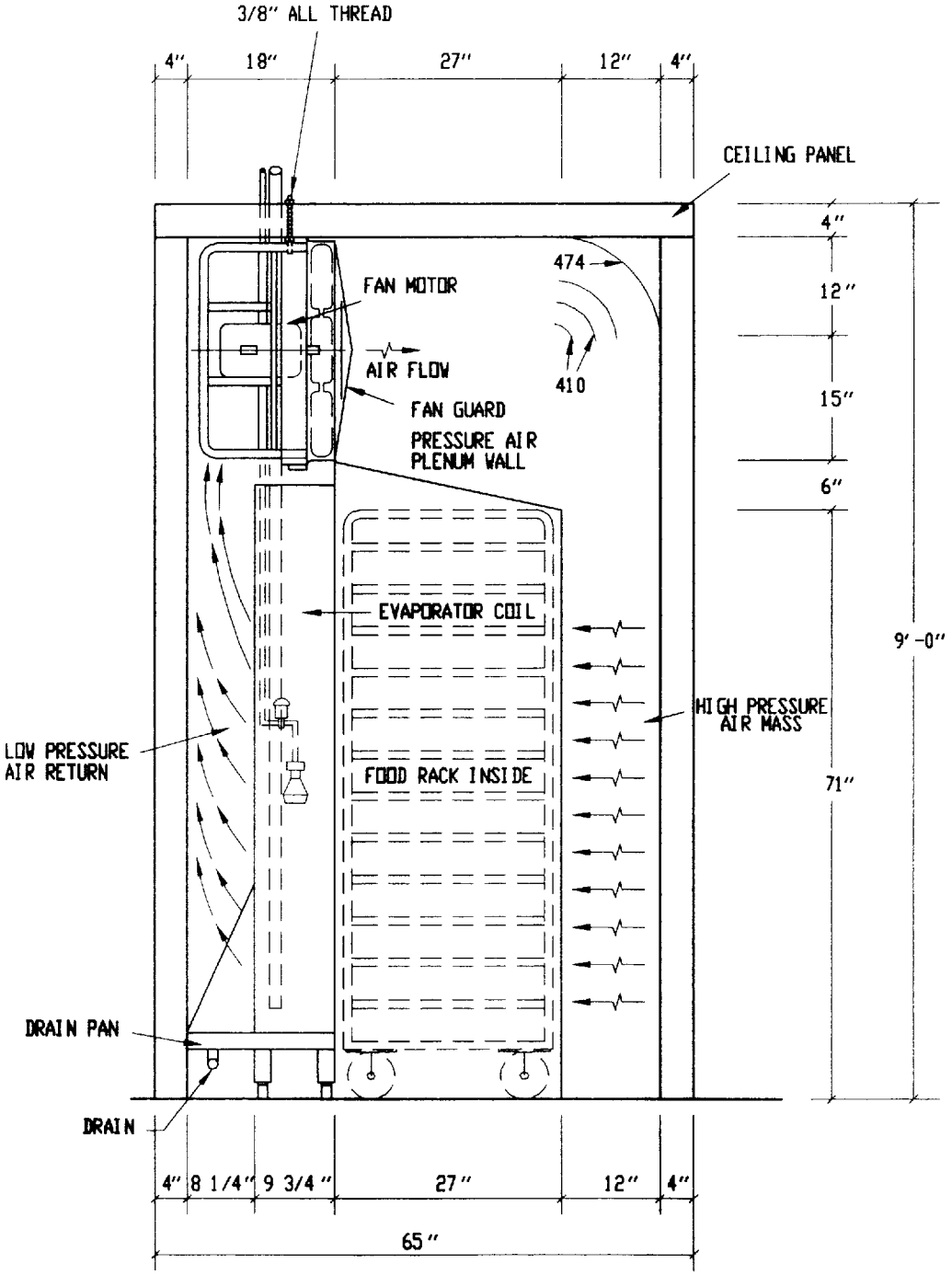
FIG. 13 is a side sectional view of another embodiment of a blast chiller in accordance with one or more principles of the present invention.

For example, interior turning leaves may be added to the corners of one or more of the air chambers in order to enhance air flow movement in some embodiments. FIG. 13 is a diagram of an embodiment similar to the view shown in the FIG. 4 or FIG. 8 embodiments, further depicting interior turning vanes 410 (such as may be used in low pressure air duct applications) placed under a corner turning vane 474.

The interior turning vanes 410 may in some embodiments reduce turbulence associated with shifting air flow by a 90-degree turn and may thereby provide a more uniform stream of air. However, interior turning vanes 410 are not necessary for proper operation of the invention and may be difficult to construct or to mount in a stable manner.

Additionally, it should be noted that while preferred embodiments have been described herein applicable to food chilling operations and, particularly, cook-chill operations, the present invention in its various embodiments is not limited to use in cooling only food products. The principles of the invention are also applicable to non-food products.

Further, although preferred embodiments have been disclosed wherein mobile carts or food racks are utilized, the invention covers similar constructions such as fixed or removable shelves instead of mobile racks, and covers shelves and racks having both uniform spacing apart as well as variable spacing, so long as there are gaps between the shelves or trays to allow air to be drawn from the high pressure cavity to the low pressure cavity.

Figure 16:
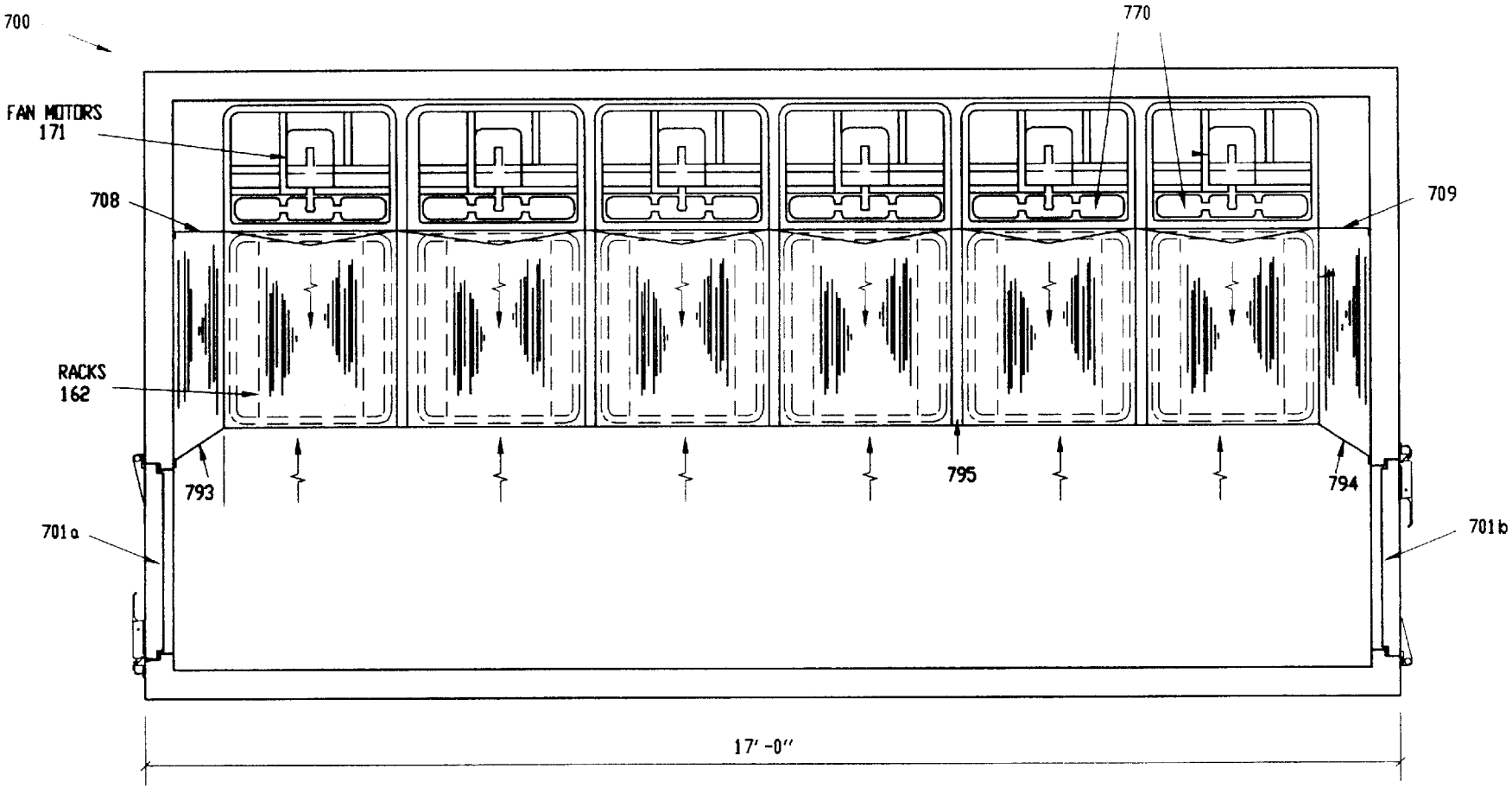
FIG. 16 is a plan view of a multi-rack embodiment of a blast chiller having a pass-through configuration.

In one alternative embodiment, multiple doors are utilized in a so-called pass-through configuration to provide multiple points of access to the blast chiller chamber. FIG. 16 is a plan view diagram showing a blast chiller 700 configured with a pass-through design. The blast chiller 700 has a first door 701*a* on one side and a second door 701*b* on the opposite side of the chamber. A plurality of racks 762 (e.g., six racks 762) may be inserted underneath a long plenum ceiling plate 795. A plurality of fans 770, one for each rack 762, are mounted in a manner similar to the dual-cart embodiment shown in FIGS. 8–10, roughly even with plenum back air walls 708 and 709. A pair of plenum air panels 793, 794 help funnel forced air from the fans 770 across the racks 762. In principle, the pass-through design of FIG. 16 generally operates in a manner similar to the embodiment shown in FIGS. 8–10.

Although embodiments have been disclosed with both one fan and multiple fans, the number of fans for a particular cooling application depends upon the cooling requirements, the number of racks being used, and the particular size and shape of chamber structure. Preferably, as shown in the embodiment of FIGS. 8–10, for example, one fan is provided for each rack, and each fan is positioned directly above one of the racks.

The position of the fan or fans may be varied without necessarily reducing the effectiveness of the invention. For example, in the FIG. 3 embodiment, moving the fan 170 forward creates an effectively larger low pressure cavity 191, and an effectively smaller high pressure cavity 190. It would be generally undesirable, however, to move the fan 170 so far forward as to prevent the air from closing out its initial vorticity, and to create undue turbulence.

Other modifications and variations will be apparent to those skilled in the art, and it is understood that the scope of the invention is not to be limited by the specific embodiments disclosed herein, but only by the appended claims.

What is claimed is:

1. A blast chiller comprising:

an insulated housing, a plenum inside said housing, said plenum comprising a first opening and a second opening, a high pressure cavity located adjacent to said first opening, said plenum comprising a funnel section connecting said plenum to said high pressure cavity whereby air is compressed from said high pressure cavity into said plenum, a low pressure cavity located adjacent to said second opening, such that air leaving said plenum is decompressed as it enters said low pressure cavity through said second opening, a motorized fan positioned in an airpath outside of said plenum and between said high pressure cavity and said low pressure cavity, said motorized fan directed to blow air towards said high pressure cavity and to remove air from said low pressure cavity, and means for reducing the air temperature within said insulated housing.

2. The blast chiller of claim 1 wherein the funnel section connecting said plenum and said high pressure cavity comprises a pair of tapered walls.

3. The blast chiller of claim 1 wherein said low pressure cavity is box-shaped and has one side connected to said second opening connecting said low pressure cavity to said plenum, said one side being wider and taller than said second opening.

4. The blast chiller of claim 1 wherein said plenum is box-shaped.

5. The blast chiller of claim 1 wherein said plenum conforms closely to the shape of an insertable rack.

6. The blast chiller of claim 1 wherein said means for reducing the air temperature within said insulated housing comprises an evaporator and a condensing unit external to said insulated housing and connected to said evaporator.

7. The blast chiller of claim 1 further comprising a turning vane positioned at the top of said high pressure cavity, said turning vane directly receiving air blown by said fan.

8. The blast chiller of claim 1 further comprising a sensor capable of insertion in a product to be cooled, and means for comparing a measured product temperature with a target product temperature and for terminating a chilling cycle upon said measured product temperature reaching said target product temperature.

9. A blast chiller comprising:

an insulated housing, a plenum inside said housing, said plenum comprising a pair of plenum side walls, a plenum ceiling, a plenum floor, a first opening at a front end of the plenum, and a second opening at a back end of the plenum, a high pressure chamber located towards the front end of said plenum, said high pressure chamber comprising a pair of high pressure chamber side walls set wider apart than said plenum side walls, a pair of tapered walls connecting said high pressure chamber side walls to said plenum side walls, such that air forced into said high pressure chamber is compressed into said plenum by said pair of tapered walls, a low pressure chamber connected by said second opening to the back end of said plenum, a secondary airpath other than said plenum connecting said high pressure chamber and said low pressure chamber, a fan disposed outside of said plenum and between said high pressure chamber and said low pressure chamber, such that air is pulled from said low pressure chamber across said secondary airpath and forced into said high pressure chamber, and a cooling evaporator within said insulated housing.

10. The blast chiller of claim 1 wherein said tapered walls are straight.

11. The blast chiller of claim 10 wherein each of said tapered walls is positioned at an angle of between forty and forty-five degrees with respect to the high pressure chamber side wall to which it is connected.

12. The blast chiller of claim 1 wherein the back end of said plenum is coextensive with said second opening, wherein said low pressure chamber comprises a plurality of sides, with one side connected to said second opening, and wherein the one side of said low pressure chamber is wider and taller than said second opening.

13. The blast chiller of claim 1 wherein said plenum is box-shaped.

14. The blast chiller of claim 1 wherein said plenum conforms closely to the shape of an insertable the rack.

15. The blast chiller of claim 1 further comprising a condensing unit external to said insulated housing and connected to said evaporator.

16. The blast chiller of claim 1 further comprising a turning vane positioned at the top of said high pressure chamber, said turning vane directly receiving air blown by said fan.

17. The blast chiller of claim 1 further comprising a sensor capable of insertion in a product to be cooled, and means for comparing a measured product temperature with a target product temperature.

18. A method of chilling comprising the steps of placing products to be cooled within a plenum, said plenum located within an insulated housing, forcing air into a high pressure cavity located at one end of said plenum, while simultaneously pulling air out from a low pressure cavity located at an opposite end of said plenum, such that air forced into said high pressure cavity is compressed by a funneling airpath as it moves from said high pressure cavity into said plenum and is decompressed as it exits said plenum and enters said low pressure cavity, cooling air as it is recirculated from said low pressure cavity to said high pressure cavity, and suspending said step of cooling upon occurrence of a predetermined condition.

19. The method of claim 18 wherein the step of placing products to be cooled within a plenum comprises the steps of placing said products on trays in a rack and inserting said rack in said plenum.

20. The method of claim 18 further comprising the step of monitoring a temperature of said product to be cooled, wherein said predetermined condition comprises said product reaching a target temperature.

21. The method of claim 18 further comprising the step of measuring a time interval, wherein said predetermined condition comprises said time interval reaching a preset value.

22. A blast chiller comprising an insulated housing, a rack having a plurality of trays, a chamber within said insulated housing, said chamber comprising a pair of side panels, a floor and a ceiling plate and conforming closely to the size of said rack, said chamber further comprising a first opening, a high pressure cavity comprising a second opening, said second opening larger in size than said first opening, a pair of tapering walls connecting said high pressure cavity and said chamber by connecting said second opening with said first opening, one tapering wall connected to each of said side panels such that air entering said high pressure cavity is compressed into said chamber by said pair of tapering walls, a low pressure cavity located at another end of said chamber and opposite from said high pressure cavity, a motorized fan positioned above said ceiling plate and outside of said chamber such that air is removed from said low pressure cavity by said motorized fan and forced across an upper surface of said ceiling plate into said high pressure cavity, and means for cooling air within said insulated housing.

23. The blast chiller of claim 22 wherein said means for cooling air comprises an evaporator positioned between said chamber and said low pressure cavity, said evaporator connected to a condensing unit.

24. The blast chiller of claim 22 wherein said rack is mobile.

25. The blast chiller of claim 22 further comprising means for sensing a temperature of a product to be cooled, a timer for measuring a chill time, and a controller for suspending a chill operation upon a measured product temperature becoming less than a target product temperature.

26. The blast chiller of claim 25 further comprising a turning vane positioned at the top of said high pressure cavity such that forced air from said motorized fan is directed into said high pressure cavity.

27. A blast chiller comprising:

an insulated housing, a rack comprising a plurality of trays adapted to hold food product, said rack insertable in said insulated housing, a motorized fan located within said insulated housing, whereby forced air is circulated across said plurality of trays, means for cooling air within said insulated housing, a sensor insertable into said food product, said sensor providing a measurement of product temperature, a controller comprising means for selecting a target product temperature and a preset chill time, means for comparing said product temperature with said target product temperature, means for comparing a time of operation of said blast chiller against said preset chill time, and means for discontinuing operation of said blast chiller upon attainment either of said product temperature with said target product temperature or of said time of operation of said blast chiller with said preset chill time.

28. The blast chiller of claim 27 further comprising a plenum within said insulated housing, said rack insertable within said plenum, wherein said motorized fan is disposed outside of and above said plenum.

29. The blast chiller of claim 27 further comprising means for recording said measurement of product temperature over a time interval.

30. A method of chilling food products comprising the steps of placing food product to be cooled on a plurality of trays, placing said trays within an insulated chamber, setting a target product temperature, selecting a cooling time interval, cooling air within said insulated chamber, circulating the cooled air across said trays, monitoring a length of time of operation of said step of circulating the cooled air across said trays, monitoring a temperature of said food product, and suspending at least one of said steps of cooling air within said insulated chamber or circulating the cooled air across said trays when either said food product temperature reaches said target product temperature or said length of time of operation reaches said preset cooling time interval.

31. The method of claim 30 wherein said trays are located on a mobile rack.

32. The method of claim 31 wherein said step of placing food product to be cooled within an insulated chamber comprises the step of placing said mobile rack within a plenum, and wherein said step of circulating the cooled air across said trays comprises the steps of forcing air into a high pressure cavity located at one end of said plenum while simultaneously pulling air out of a low pressure cavity located at an opposite end of said plenum such that air is compressed into said plenum through a funneling airpath and decompressed as it exits said plenum and enters said low pressure cavity.

* * * * *